US006401468B1

(12) United States Patent
Hoyle et al.

(10) Patent No.: US 6,401,468 B1
(45) Date of Patent: Jun. 11, 2002

(54) AUTONOMOUS CONTROL OF HEAT EXCHANGERS

(75) Inventors: Scott Baxter Hoyle, Maple Shade; Michael Anthony McSweeney, Spotswood, both of NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/818,717

(22) Filed: Mar. 27, 2001

(51) Int. Cl.[7] ..... F25B 7/00
(52) U.S. Cl. ..... 62/175; 236/51
(58) Field of Search ..... 62/175, 203, 125, 62/126, 127, 129, 130, 229, 176.1, 176.6; 236/51, 44 R, 44 A, 44 C, 44 E, 91 R, 91 C; 165/205, 207, 208, 209

(56) References Cited

U.S. PATENT DOCUMENTS 5,435,147 A * 7/1995 Mochizuki et al. ..... 236/51 X
5,642,857 A * 7/1997 Totsuka et al. ..... 236/51
5,853,123 A * 12/1998 Okano et al. ..... 62/175 X
6,009,939 A * 1/2000 Nakanishi et al. ..... 236/51 X
6,026,652 A * 2/2000 Wada ..... 62/175

* cited by examiner

*Primary Examiner*—Harry B. Tanner
(74) *Attorney, Agent, or Firm*—Duane Morris LLP

(57) ABSTRACT

A heat exchange assemblage is adapted for use with other such heat exchange assemblages for cooling or heating a controlled environment, or controlling the humidity thereof. Each heat exchange assemblage is intended for use in conjunction with a communication network linking all such heat exchange assemblages, but each can operate autonomously if the network fails. Each heat exchange assemblage includes a heat pump and a controller. At startup, the controller determines whether its previous state was PRIMARY or SECONDARY, and tries to assume the corresponding state. If no one assemblage assumes PRIMARY status, a random scheme in conjunction with communications aids in establishing one of the assemblages as PRIMARY, while others remain SECONDARY. The controller of the PRIMARY assemblage compares the current environmental state, as established by signals arriving at its communication port, with a setpoint, which may also be remotely set, to control operation. A SECONDARY assemblage may compare the rate of change of the current environmental state with a rate-of-change setpoint, to determine when the SECONDARY assemblage should operate.

5 Claims, 14 Drawing Sheets

AUTONOMOUS CONTROL OF HEAT EXCHANGERS

FIELD OF THE INVENTION

This invention relates to autonomous local control of heat-exchange equipments which are usable andor used in the context of an interconnecting network that provides for exchange of data relating to the status of the equipments and a controlled environment.

BACKGROUND OF THE INVENTION

Seagoing vessels, regardless of whether they are intended for sport, commerce, or warfare, share in common the need to maintain their buoyancy and control in the face of potentially violent conditions including storms, grounding, andor hostile action. Maintaining control and buoyancy in the face of damage due to such violent conditions may require rapid amelioration of, or adaptation to, such damage. In a large ship, there may be many compartments, the entrances to which are separated by a sufficient distance from each other so that considerable time may be required for movement from one compartment to another. The existence of such compartments has in the past given rise to the need for an observer assigned to each compartment or set of compartments to monitor conditions. It might be thought that speaker tubes or telephones would be suitable for communicating between each of the various compartments and a control center or bridge, but there is a real possibility that damage to a compartment might also damage the communications equipment. Consequently, warships assign crew members to be messengers, whose duty is to carry information from the compartments to the control center or bridge in the event of a break in the communications. Damage to one compartment of a ship may require adjustments in many compartments, as for example when flooding of a compartment requires redistribution of the ship's load or supplies to prevent excessive list. The adjustments may include operation of valves and switches within the compartments, as might be required, for example, to start pumps and open valves for the dumping overboard of bilge water, or for redistributing liquid fuel from tanks on one side of the ship to tanks on the other side. Because time is very important when attempting to cope with damage, warships have in the past stationed crews at various locations about the ship. These crews are charged with the duties of operating valves and switches as commanded or trained. In addition to such adjustments, additional crews must be provided to be on standby for firefighting, for damage repair, and for tending the injured. In the case of a warship, a portion of the crew must additionally be used for manning weapons and countermeasure. Since the tending of injured presupposes that some of the crew is not capable of performing its duties, the crew must, even when reduced in number by casualties, be large enough to be able to perform all of the tasks associated with tending a ship in distress. All of these considerations result in the manning of ships with crews large enough to provide "surge" capability for the handling of any emergency. A large battleship of WWII vintage had a crew in excess of 3000 men, and an aircraft carrier in the vicinity of 5000. Even modern missile destroyers require crews exceeding 300 persons.

The presence of such large crews inevitably has its effects on ship design. It will be clear that the housekeeping and support requirements tend to expand disproportionally as the crew grows larger. The ship itself must be large in order to hold the oversize crew, and must carry additional stores such as food, which makes it larger still. Food preparation areas must be larger with a large crew, and the additional food preparation personnel in turn require their own support staff and ship facilities. The cost of ships is adversely affected by the need for a crew of a size to provide surge capability, and the cost of operating such ships is directly increased by the supernumerary members of the crew. The operating cost is further increased by the need to maintain the supernumerary members. It is thus of great importance in ship design to take into account the staffing requirements of the ship, and to improve ship design in such a manner as to minimize the crew size.

A solution to a portion of the ship design is described in conjunction with U.S. patent application Ser. No. 09/608,829, filed Jun. 30, 2000 in the name of Hoyle et al. As described generally therein, a fluid-handling system described in the context of a shipboard cooling arrangement in which a plurality of autonomously controlled valves, flow sensors and possibly pressure sensors are interconnected by a data network, and each autonomous control decides for itself, based on prestored information relating to its "location" in the fluid network, an environmental "context," and also based on the reported conditions on the network, the operating condition it should assume, as for example "open" or "closed."

In FIG. 1, a flow system 10 as described in conjunction with the abovementioned Hoyle et al. '829 application includes a source 12 of pressurized fluid, such as water. As illustrated, source 12 may include a pump 12*p* coupled by a tube 12*t* to a source of water, which may be a tube extending through the hull of a ship so as to allow pump 12*p* to draw salt water from the ocean. Pump 12*p* is controlled by a controller 12*c* as described below. Pump 12*p* provides pressurized fluid through a fluid flow sensor 56 to a pipe tee or bifurcation 32, which provides pressurized fluid to a flow path or pipe 21 by way of a software-controlled valve 41 and a flow sensor 51. Software-controlled valve 41 is controlled by an independent program associated with a valve controller 41*c*. Bifurcation 32 also provides pressurized fluid to a second flow path 22 by way of a software-controlled valve 42 and a flow sensor 52. Software-controlled valve 42 is controlled by an independent program associated with a valve controller 42*c*. When valve 41 is open (allows flow of fluid) and pump 12*p* is in operation, pressurized fluid is coupled to a tee junction or bifurcation 33, and fluid flows through one of a set 1 of two heat exchangers, and more particularly from heat exchanger input port 61*i* through a heat exchanger 61 to a heat exchanger output port 61*o*, through a flow sensor 54 to a further tee junction or bifurcation 31, and to a drain designated 9. It should be noted that this description assumes the presence of a fluid path from the input port of the heat exchanger to the output port, and this path is not explicitly illustrated. When valve 42 is open and pump 12*p* is in operation, pressurized fluid is coupled to a tee junction or bifurcation 34, and as a result fluid flows from an input port 62*i*, through a heat exchanger 62 to an output port 62*o*, through a flow sensor 55, to a tee junction or bifurcation 31, and to drain 9.

While the flow meters of FIG. 1 are illustrated as being separate from the controllable valves, they may be physically integrated into the same device or housing, and use common power supplies, logic hardware, and network connections.

The controllable valves 41, 42, and 43 of FIG. 1 may be located in a ship and connected for the flow of fluid in a manner described in more detail in U.S. patent application Ser. No. 09/571,346 filed on May 16, 2000 in the name of Hoyle et al. The controllable valves may be of any kind, but are preferably the type described in U.S. patent application Ser. No. 09/375,695 filed on Aug. 17, 1999 in the name of Hoyle et al. The flow sensors may be of any kind, but are preferably the unidirectional-flow-sensing type described in U.S. patent application Ser. No. 09/349,576 filed on Jul. 8, 1999 in the name of Hoyle et al., or of the bidirectional type described in U.S. patent application Ser. No. 09/487,848 filed Jan. 19, 2000 in the name of Hoyle et al.

The arrangement 10 of FIG. 1 also includes a further flow path 23 coupled between tee junctions 33 and 34. Flow path 23 includes flow paths 23*a* and 23*b*, a flow sensor 53, and also includes a software-controlled valve 43 controlled by a controller 43*c*.

In FIG. 1, a communication network, illustrated as a block 70, couples valve controllers 41*c*, 42*c*, and 43*c* with flow sensors 51, 52, 53, 54, 55, and 56, and with pump controller (CNTL) 12*c*. Each valve controller 41*c*, 42*c*, and 43*c* is associated with, or contains, an independent logic system, which may be in the form of dedicated hardware, or preferably software, which acts, in conjunction with the communication network 70, as a distributed control system for controlling the fluid flow system 10 under a variety of conditions. The advantage of a distributed control system is that it is robust, with any undamaged subportion of the system 10 continuing to operate properly notwithstanding damage to, or failure of, other portions of the system 10. Thus, undamaged portions of the distributed control system continue to function notwithstanding damage to a portion of the overall control system, much as the uninjured members of a crew can continue to perform their duties notwithstanding incapacity of some crew members.

FIG. 2 is a simplified block diagram of a fluid distribution system 210 more complex than, but generally similar in effect, to the arrangement 10 of FIG. 1. In FIG. 2, source 12 of pressurized fluid includes a fluid supply tube 12*t* which supplies fluid to a set 202 of three pumps 12*p*, 212$p_1$, and 212$p_2$, which are controlled by controllers 12*pc*, 212$p_1c$, and 212$p_2c$, respectively. When in operation, each pump 12*p*, 212$p_1$, and 212$p_2$ produces pressurized fluid at an associated tee junction or bifurcation 32, 232$_1$, and 232$_2$. A flow sensor 56 measures the fluid flow through pump 12*p*, a flow sensor 256$_1$ measures the fluid flow through pump 212$p_1$, and a flow sensor 256$_2$ measures the fluid flow through pump 212$p_2$. A software-controlled valve 241$_1$ with a controller 241$_1c$ is serially coupled with a flow sensor 251$_1$ to provide a path for the flow of fluid between tees or bifurcations 32 and 232$_1$. Similarly, a software-controlled valve 241$_2$ with a controller 241$_2c$ is serially coupled with a flow sensor 251$_2$ to provide a path for the flow of fluid between tee or bifurcation 232$_1$ and flow path 221. A software-controlled valve 242$_1$ with a controller 242$_1c$ is serially coupled with a flow sensor 252$_1$ to provide a path for the flow of fluid between tees or bifurcations 32 and 232$_2$. A software-controlled valve 242$_2$ with a controller 242$_2c$ is serially coupled with a flow sensor 251$_2$ to provide a path for the flow of fluid between tee or bifurcation 232$_2$ and fluid path or pipe 222. Thus, triply-redundant pumps 12*p*, 212$p_1$, and 212$p_2$, when energized, provide pressurized fluid to tees or bifurcations 32, 232$_1$, andor 232$_2$, and, depending upon the states of the valves, the pressurized fluid may be supplied to path 221, 222, or both 221 and 222.

The arrangement of FIG. 2 includes a set 201 including a plurality equal to five of heat exchangers, described below. In FIG. 2, a pair of heat exchangers 261$_1$ and 261$_2$ are operated in parallel by having their input ports 261$_1i$ and 261$_2i$ coupled to tee or bifurcation 233 by way of fluid flow paths 224$_1$ and 224$_2$, respectively, and by having their output ports 261$_1o$ and 261$_2o$ coupled to tee or bifurcation 231$_1$. Similarly, a pair of heat exchangers 262$_1$ and 262$_2$ are operated in parallel by having their input ports 262$_1i$ and 262$_2i$, respectively, coupled to tee or bifurcation 234, and by having their output ports 262$_1o$ and 262$_2o$, respectively, coupled to tee or bifurcation 231$_2$. Heat exchanger sets 261$_1$, 261$_2$ and 262$_1$, 262$_2$ are connected to fluid source pipes 221 and 222 by means of software-controlled valves: a software-controlled valve 243, which is controlled by a controller 243*c*, is serially coupled with a flow sensor 253 in a path 223 extending from tee or bifurcation 233 to tee or bifurcation 234, a software-controlled valve 243$_1$, which is controlled by a controller 243$_1c$, is serially coupled with a flow sensor 253$_1$ in a path 223$_1$ extending from tee or bifurcation 233 to tee or bifurcation 235, and a software-controlled valve 243$_2$, which is controlled by a controller 243$_2c$, is serially coupled with a flow sensor 253$_2$ in a path 223$_2$ extending from tee or bifurcation 234 to tee or bifurcation 236. Heat exchanger sets 261$_1$, 261$_2$ and 262$_1$, 262$_2$ are connected to fluid drain pipes 221$_1$ and 222$_1$ by means of software-controlled valves: a software-controlled valve 248$_1$, which is controlled by a controller 248$_1c$, is serially coupled with a flow sensor 258$_1c$ in a path 249$_1$ extending from tee or bifurcation 231$_1$ to tee or bifurcation 231$_2$, a software-controlled valve 248$_2$, which is controlled by a controller 248$_2c$, is serially coupled with a flow sensor 258$_2$ in a path 249$_2$ extending from tee or bifurcation 231$_1$ to tee or bifurcation 231$_3$, and a software-controlled valve 248$_3$, which is controlled by a controller 248$_3c$, is serially coupled with a flow sensor 258$_3$ in a path 249$_3$ extending from tee or bifurcation 231$_2$ to tee or bifurcation 231$_4$.

Also in FIG. 2, a further heat exchanger 271 has a (nominally input) port 271*i* connected for the flow of fluid to a tee or bifurcation 237, and also has a (nominally output) port 271*o* connected to a tee or bifurcation 231$_5$. Bifurcation 237 is coupled to source fluid paths 221 and 222 by way of software-controlled valves 244$_1$ (controlled by controller 244$_1c$) and 244$_2$ (controlled by controller 244$_2c$). Valves 244$_1$ and 244$_2$ are serially coupled with flow sensors 257$_1$ and 257$_2$, respectively. Heat exchanger 271 has its (nominally) output port 271*o* and tee or bifurcation 231$_5$ coupled to source drain paths 221$_1$ and 222$_1$ by way of software-controlled valves 248$_4$ (controlled by controller 248$_4c$) and 248$_5$ (controlled by controller 248$_5c$). Valves 248$_4$ and 248$_5$ are serially coupled with flow sensors 258$_4$ and 258$_5$, respectively.

In operation of the arrangement of FIG. 2, either or both of fluid source paths 221 or 222 can be pressurized by operation of any one of the pumps 12*p*, 212$p_1$, andor 212$p_2$, by operating valves 241$_1$, 241$_2$, 242$_1$, and 242$_2$ to an appropriate position. For example, pump 12*p* can pressurize path 221 by opening valves 241$_1$ and 241$_2$, while path 222 can additionally be pressurized by opening valves 242$_1$ and 242$_2$. If, on the other hand, only pump 212$p_1$ is energized, path 221 can be pressurized by opening only valve 241$_2$, while path 222 can additionally be pressurized by opening valves 241$_1$, 242$_1$ and 242$_2$. With source pipes 221 and 222 pressurized by operation of pump 212$p_1$, pipe 221 can be "depressurized" by closing valve 241$_2$, assuming that no other path provides pressurization. Other combinations of open (flow allowed) and closed (flow prevented) conditions of various ones of valves 241$_1$, 241$_2$, 242$_1$, and 242$_2$ allow any or all of the pumps 12*p*, 212$p_1$, andor 212$p_2$ to pressurize either or both of paths 221 and 222.

Bifurcation 235 of FIG. 2 allows fluid pressure in path 221 to be communicated to valves 243$_1$ and 244$_2$, while bifurcation 236 allows fluid pressure in path 222 to be communicated to valves $\mathbf{243}_2$ and $\mathbf{244}_2$. Opening any one of these valves allows fluid under pressure to be applied to the input port of at least one of the heat exchangers. More particularly, if path 221 is pressurized, opening valve $\mathbf{243}_1$ allows pressurized fluid to reach the input ports $\mathbf{261}_1 i$ and $\mathbf{261}_2 i$ of heat exchanger set $\mathbf{261}_1$ and $\mathbf{261}_2$, and opening valve $\mathbf{244}_1$ allows pressurized fluid to reach the input port 271*i* of heat exchanger 271. If path 222 is pressurized, opening valve $\mathbf{243}_2$ allows pressurized fluid to reach the input ports $\mathbf{262}_1 i$ and $\mathbf{262}_2 i$ of heat exchanger set $\mathbf{262}_1$ and $\mathbf{262}_2$, and opening valve $\mathbf{244}_2$ allows pressurized fluid to reach the input port 271*i* of heat exchanger 271. Thus, pressurized fluid can reach the input port 271*i* of heat exchanger 271 by way of either valve $\mathbf{244}_1$ or $\mathbf{244}_2$, or by way of both if both valves are in the open state.

Just as pressurized fluid may be coupled to the input port 271*i* of heat exchanger 271 by either or both of two paths including paths 221 and 222, pressurized fluid may be coupled by either or both of two paths, including paths 221 and 222, to the input ports $\mathbf{261}_1 i$, $\mathbf{261}_2 i$, $\mathbf{262}_1 i$, $\mathbf{262}_2 i$ of heat exchangers $\mathbf{261}_1$, $\mathbf{261}_2$, $\mathbf{262}_1$, and $\mathbf{262}_2$, by opening valve 243 in conjunction with the opening of at least one of valves $\mathbf{243}_1$ and $\mathbf{243}_2$.

Unlike the arrangement of FIG. 1, the arrangement of FIG. 2 includes valves in the drain paths. Valves in the drain paths may be desirable to prevent backflow and to allow maintenance on or replacement of particular units. The main drain paths are designated $\mathbf{221}_1$ and $\mathbf{222}_1$ in FIG. 2. Drain paths $\mathbf{221}_1$ and $\mathbf{222}_1$ join at a tee or bifurcation 31, and the common port of the tee is coupled to drain 9. Fluid having passed through heat exchanger 271 exits by way of port 271*o* and arrives at tee or bifurcation $\mathbf{231}_5$. If valve $\mathbf{248}_4$ is open, the fluid from output port 271*o* flows from tee or bifurcation $\mathbf{231}_5$ to drain path $\mathbf{221}_1$ and thence to drain 9. On the other hand, if valve $\mathbf{248}_5$ is open, the fluid from output port 271*o* flows from tee or bifurcation $\mathbf{231}_5$ to drain path $\mathbf{222}_1$ and thence to drain 9. If both valves $\mathbf{248}_4$ and $\mathbf{248}_5$ are open, fluid can flow from drain port 271*o* to drain 9 by way of two paths. Similarly, there are multiple paths for the flow of fluid from the drain ports $\mathbf{261}_1 o$, $\mathbf{261}_2 o$, $\mathbf{262}_1 o$, $\mathbf{262}_2 o$ of heat exchangers $\mathbf{261}_1$, $\mathbf{261}_2$, $\mathbf{262}_1$, and $\mathbf{262}_2$, respectively, to drain 9. Opening valve $\mathbf{248}_2$ allows drain fluid to flow from tee or bifurcation $\mathbf{231}_1$ to drain 9 by way of path $\mathbf{221}_1$, and opening valve $\mathbf{248}_3$ allows drain fluid to flow from tee or bifurcation $\mathbf{231}_2$ to drain 9 by way of path $\mathbf{222}_1$. Opening valve $\mathbf{248}_1$ allows drain fluid to flow between tees or bifurcations $\mathbf{231}_1$ and $\mathbf{231}_2$, thus allowing drain fluid from heat exchanger drain ports $\mathbf{261}_1 o$, $\mathbf{261}_2 o$, $\mathbf{262}_1 o$, $\mathbf{262}_2 o$ of heat exchangers $\mathbf{261}_1$, $\mathbf{261}_2$, $\mathbf{262}_1$, and $\mathbf{262}_2$, respectively, to flow by that one of paths $\mathbf{221}_1$ or $\mathbf{222}_1$, or both, as permitted by the states of valves $\mathbf{248}_2$ and $\mathbf{248}_3$. As in the case of the arrangement of FIG. 1, a network 70 interconnects the various valve controllers, flow valves, and pump controllers so that information relating to the valve states and flow rates may be received by each of the valve and pump controllers.

FIG. 3 is a highly simplified block diagram representing a portion 301 of the software which resides at, or is associated with, each valve controller of the arrangements of FIGS. 1 and 2. In addition to the illustrated software, each valve will have resident or associated equipment and software (not illustrated) for communicating over the network 70 of FIGS. 1 and 2, and valve operating equipment (not illustrated) for actually controlling the state of the fluid valve. The valve operating equipment may include electrically, pneumatically, andor hydraulically-powered motors or drivers. Some valves might even be powered by stored mechanical energy, as for example by a wind-up spring or a weight-and-pulley arrangement.

Software block 310 of software 301 of FIG. 3 represents the main processing flow for determining or commanding the state of the associated valve. Block 310 receives information from an ancillary processing block 312 by way of paths designated B and D. Block 310 produces commands which proceed by way of a path designated A to a leak detection and status monitoring block 312. Block 314 represents a logic arrangement for collecting status information from flow meters, pressure sensors and valve state establishing the times at which various calculations are performed. The timing of the calculations is important, because the information on which the calculations are based may have been sensed at different times, thereby tending to reduce the relationship among different quantities. For example, if the flow through a flow sensor of FIG. 1 is measured or sensed to be zero at time t1, and the pressure in the associated pipe is measured to be low at a later time, calculation may lead to the erroneous conclusion that the pump is not pumping hard enough, when simultaneous measurements might reveal that the pipe pressure is low, but also that there is a large fluid flow through the sensor. Such a condition might lead to a correct conclusion (for some situations) that there is a break in the pipe downstream from the sensor. The timing provided by block 314 of FIG. 3 aligns the measurement times so the calculations are meaningful.

FIG. 4 is a simplified flow chart or diagram illustrating the main logic sequence of block 310 of FIG. 3. In FIG. 4, the logic can be viewed as starting at a block 410, representing power-up or reset. The logic traverses various logic paths continuously in normal operation. From block 410, the logic flows to a block 412, which represents resetting of the system timers. The default values of the software are used to set the correct initial position of the valve. With the system timers reset, the logic branches over path or node A to leak detection and status monitoring block 312 of FIG. 3. From block 412, the logic flows to a block 414, which represents determination of the current state or position of the associated valve as being nominally open (fluid flow permitted), closed (no fluid flow) or (in some embodiments) at positions between open and closed. From block 414, the logic of FIG. 4 flows to a block 416. Block 416 receives information relating to the system context from network 70 of FIGS. 1 and 2. The system context information tells the valve the conditions under which the ship is operating, which may include such conditions as "docked," "normal," and "battle." This is merely a memory store which stores information from a remote source for use by the logic flow. From block 416, the logic flows to block 418, which combines the information from block 416 with information telling the valve "where it is" in the context of the system, so that the autonomous logic of FIG. 4 for each valve can interact, by way of the network, with sensors and with other valves of the system in a quasi-intelligent manner to achieve the desired result. The system configuration information is maintained in a memory designated 420. The system configuration information is a setting for each valve which describes it in functional terms, such as a "root" valve, which allows flow or a cross-connect valve, which allows selection from among multiple paths. In general, the location or system configuration information contained in block 420 does not change from time to time, as the valve ordinarily stays in the same location in the same plumbing system. The only situations in which the memorized configuration information might be changed include in conjunction with reconfiguration of the plumbing system or removal of a valve (with its software) to another location in the same or a different plumbing system.

From block 418 of FIG. 4, the logic flows to a driver block 422, which represents the setting of the associated valve to the position determined in block 418.

From block 422 of FIG. 4, the logic proceeds to a decision block 424. Block 424 responds to the command from driver block 422 or to the leak- or error-condition command from node B, generated in the logic flow of FIG. 5. Block 424 of FIG. 4 compares the commanded state of the valve with the current valve position. If no change in the position of the valve is required in order to meet the commanded position, the logic leaves decision block 424 by the NO output, and arrives at a block 426. If a change in position of the valve is required, the logic leaves decision block 424 by the YES output and effects the position change, and the logic then arrives at block 426. Block 424 must resolve conflicting valve state commands in some cases. For example, if the normal configuration command is produced by block 422 and a "close valve" command is received by way of node B, block 424 uses logic which may be dependent upon the configuration properties to resolve the conflict. Ordinarily, the emergency-condition command arriving by way of node B will override the normal-mode commands from block 422.

Block 426 of FIG. 4 updates the valve-position variable, and makes it available is to other controllable valves of the system by way of the interconnecting network 70 of FIGS. 1 and 2. From block 426, the logic flows to an END or Pause block 428, in which the logic resides until the next logic cycle is initiated.

FIG. 5 is a simplified representation of the logic of block 312 of FIG. 3. In FIG. 5, the logic includes a plurality of timers which recurrently count down from some preset time, as for example 30 seconds. In FIG. 5, block 510 is a flow check timer, block 512 is a status reporting timer, and block 514 is a loss-of-communication timer which seeks input from the inter-valve network, and which deems the interconnection to the valve with which it is associated to be broken if no input is received within a particular interval. Each of flow check timer 510, status reporting timer 512, and loss-of-communication timer 514 is connected to a timer reset block 516, 518, and 520, respectively. These timer reset blocks cause the associated counters to reset to their starting values upon occurrence of a complete count. Status reporting timer reset block 518 is connected to a block 522, which represents the sending or reporting from the associated controllable valve to the interconnection system 70 (FIGS. 1 and 2) of the current status or state of the valve, and of the flow through any associated flow meter. The reporting of such information from the associated valve to the network 70 is thus under the control of timer 512.

From timer reset block 516 of FIG. 5, the logic flows to a block 524 and by way of a path 525 to a block 526. Block 526 is the first block in a logic which determines flow direction through the associated valve. If the associated flow meter happens to be bidirectional, then the determination of the logic flow beginning at block 526 can be simplified to a mere decision block. If the associated flow meter is not bidirectional, block 526 represents determination of the relative pressures on each side of the associated valve, and determination of that one of the pressures which is greatest. Block 528 represents selection of the system configuration used in the associated valve based upon the flow direction. This is an either/or determination. From block 528, the logic flows to a block 530, which represents selecting the system configuration, selected from among the configurations stored in block 420 of FIG. 4. From block 530, the logic flows to end or pause block 428.

From timer reset block 516 of FIG. 5, the logic flow to block 524 begins leak or broken-pipe detection for the associated valve. Block 524 sums the fluid flows in the nearest neighbor of the system configuration stored in block 530 of FIG. 5. For example, if the associated valve of the logic of FIGS. 4 and 5 happens to be valve $\mathbf{244}_2$ of FIG. 2, then the configuration information or table stored in block 530 includes information to the effect that the input fluid flow of the associated valve $\mathbf{244}_2$ equals the fluid flow through valve $\mathbf{241}_2$, and the output fluid flow equals the sum of the fluid flows through valves $\mathbf{244}_1$, $\mathbf{248}_4$, and $\mathbf{248}_5$. The assumption is made that the fluid flow through any valve is the same as that of the associated flow sensor, regardless of whether the flow sensor is integrated with the valve or whether it is a separate item located near the valve. Block 524 of FIG. 5 sums the flows, and the resulting sum should be in balance. The sum information from block 524 is evaluated by a decision block 532, which compares the imbalance with a tolerance which is determined by the tolerances in the flow measuring devices. Only those out-of-balance conditions which exceed the tolerances are deemed to be important. Since there may be transient imbalances, no single imbalance measurement is relied upon, but a sequence of plural imbalances are the criterion for declaring a leak or a break. For this purpose, the significant error conditions flowing from the ERROR output of block 532 are applied to an INCREMENT input port of an error counter 534, which increments. If decision block 532 detects a non-error condition during a clock cycle, the error counter 534 is reset to zero by a signal applied to the RESET input port. So long as a particular number of consecutive error conditions do not occur, error counter 534 produces no output on NO-LEAK logic path 536, and the logic flows to END or PAUSE block 428. Upon the occurrence of the selected number of errors, counter 534 produces a leak error signal and applies it to a block 538, which declares a leak. Block 540 represents the setting of the position of the associated valve to the position established by the configuration information for a leak condition. Most valves would be set to the closed state in the event of a leak, but there may be unusual circumstances in which the valve is not closed, but the leak is reported. From block 540, the logic flows to logic node B.

From update timer reset block 520 of FIG. 5, the logic flows to a block 550, which represents the determination of the existence of update signals from the neighbors during the update interval. Thus, if the associated valve is valve $\mathbf{244}_2$, and its neighbors are $\mathbf{242}_2$, $\mathbf{244}_1$, $\mathbf{248}_4$, and $\mathbf{248}_5$, block 550 determines that signals have arrived from these four neighbors. Block 552 determines if the fluid flow information is not being updated, and generates logic signals which are passed to a block 554. Block 554 represents the setting of the associated valve to the position based on the configuration (which depends upon the operating mode). From block 554, the logic flows to node B which returns to block 424 of FIG. 4. If pressure information from the neighbors is not being updated, block 556 responds, and the logic flows back to block 426 of FIG. 4 by way of node D.

Status information collection block 314 of FIG. 6 collects information which arrives from mutually unsynchronized controllable valves. The information is captured, and temporarily stored in memory until it is needed by other portions of the logic. In FIG. 6, blocks $\mathbf{610}_1 \ldots \mathbf{610}_n$ represent input messages occurring at different times, arriving by way of the network from neighbor flow meters associated with flow paths which provide fluid flow to the associated valve, blocks $\mathbf{612}_1$ . . . $\mathbf{612}_n$ represent input messages occurring at different times, arriving by way of the network from neighbor flow meters associated with output fluid flows, and blocks $\mathbf{614}_1$ . . . $\mathbf{614}_n$ represent messages occurring at different times, arriving by way of the network from neighbor pressure meters. All of the messages arrive at a block 616, which represents storage of the messages at the times at which they arrive, together with a message header indicating the source of the information and the time of arrival. Block 618 distributes the information to the appropriate locations in an array 620 which facilitates processing for leak detection. Array 620 includes locations for each element of flow-in information, together with time of arrival, locations for each element of flow-out information, together with time of arrival, and locations for each element of pressure information, together with time of arrival. The array information is made available to other portions of the logic, under command by way of node C from the update timer 514 of FIG. 5. From the array 620 of FIG. 6, the logic flows to END or PAUSE block 428.

An embodiment of a system of independently-or autonomously-controllable valves substantially in accordance with the above description was produced and tested in conjunction with flow systems more complex than those of FIGS. 1 and 2, and was found to operate satisfactorily. One insight which was derived experimentally was that a flow sensor is desirably associated with each of the controllable valves. It was found that systems containing fewer flow determinations than valves were difficult to stabilize under some conditions. It is believed that the use of more accurate flow sensors might allow adequate system stability with fewer flow sensors than controllable valves.

A solution to another portion of the ship design is described in conjunction with U.S. patent application Ser. No. 09/654,732, filed Sep. 5, 2000 in the name of Hoyle et al. As described generally therein, a plurality of autonomously controlled pumps are used in a fluid distribution system with the autonomously controlled valves interconnected by a data communication network similar to that of the '829 application. The actions taken by the pumps are established by the autonomous controllers regardless of the existence of a connection to the network, so that even if the network connection fails or is damaged, the valve or pump can still respond with predetermined "intelligent" actions.

As described in the abovementioned Hoyle et al. Ser. No. 09/654,732 application, a fluid circulation system 700 in FIG. 7 includes a fluid affecting device, which is illustrated as a block 61, corresponding to a heat exchanger of FIG. 1, but which may be any other device which uses fluid and has some effect on the fluid, as for example by raising or lowering its temperature. The fluid affecting device 61 of FIG. 7 has a fluid input port 61*i* and a fluid output port 61*o* coupled by way of a pipe 54*p* to a drain 9. A sensor 754 is associated with fluid affecting device 61. Sensor 754 may be a pressure sensor coupled to sense the fluid pressure at the input or output port of the fluid affecting device 61, or it may be a flow sensor coupled for sensing the flow through the fluid affecting device. Sensor 754 is coupled by a communication path 754*c* to communication network 70.

A source 710 of pressurized fluid in FIG. 7 provides pressurized fluid by way of a pipe 710*p* to fluid input port 61*i* of fluid affecting device 61. Source 710 includes a set 702 of pumps including a first controllable pump 12 and a second controllable pump 712. Pump 12 includes the actual pump (motor and impeller, for example) 12*p*, and also includes a check valve 12*pck* for reducing backflow of fluid into pump 12 pressure port $\mathbf{12}p_p$ if pump 12*p* is of a type, such as a centrifugal type, which allows such flow when deenergized. Check valve 12*pck* may be dispensed with if the pump 12*p* is of a type, such as a positive-displacement type, which does not allow back flow when inoperative. Pump 12 also includes a controller (CNTL) 12*pc*, which is connected to a power source, and is also connected to network 70. Controller 12*pc* includes an independent program (hardware, software, or firmware) which senses the condition of the pump 12, and reports the condition to the network 70, and also includes control portions, described below, so that (a) if the sensed parameter is such as to require fluid flow, determining if that one of the first and second pumps with which it is not associated is pumping, and (b) energizing the associated pump if the sensed parameter is such as to require fluid flow and that one of the pumps with which it is not associated is not pumping. Put another way, the program associated with pump 12 determines from information received from the network 70: (a) if sensor 754 is calling for fluid, (b) if pump 712 is operating or pumping, and then starts pump 12*p* if pump 712 is not pumping.

Similarly, source 710 of FIG. 7 includes a second pump 712. Pump 712 of FIG. 7 includes the actual pump 712*p*, and also includes a check valve 712*pck*, if necessary, coupled between pump 712*p* and pressure port 712*pp* of pump 712. Pump 712 also includes a controller (CNTL) 712*pc*, which is connected to a power source, and is also connected to network 70. Controller 712*pc* includes an independent program which senses the condition of the pump 712, and reports the condition to the network 70, and also includes control portions, described below, so that (a) if the sensed parameter is such as to require fluid flow, determining if that one of the first and second pumps with which it is not associated (that is, pump 12) is pumping, and (b) energizing the associated pump (that is, pump 712) if the sensed parameter is such as to require fluid flow and that one of the pumps with which it is not associated (pump 12) is not pumping. Put another way, the program associated with pump 712 determines from information received from the network 70 if sensor 754 is calling for fluid, determines if pump 12 is operating or pumping, and starts pump 712*p* if pump 12 is not pumping. Thus, two substantially identical pumps, each having an independent program associated with it, co-act in an "intelligent" manner to assure a supply of fluid to the using device when the using device calls for fluid. Damage to, or destruction of, one of the two pumps does not, in principle, prevent the other from operating, thus achieving substantial redundancy and consequent reliability. Similarly, a break in the communication path between the network and one of the pumps will be treated as a failure of the pump so disconnected.

FIG. 8 is an overall flow chart or diagram of the software associated with each of the pumps 12 and 712 of FIG. 7. In FIG. 8, the logic starts at a start block 810, and proceeds to a decision block 812. Decision block 812 looks to an internal memory, which is preferably of a nonvolatile type, to determine if the associated pump is deemed to be a primary pump or a secondary pump. This is initial information which may be preloaded into the memory for each pump in the fluid system. If the associated pump is deemed to be secondary, the logic flows from the NO output of decision block 812 to a further block 814, which represents waiting or looking for a status message from the primary pump. From block 814, the logic flows to a logic node A. If the associated pump is deemed to be primary, the logic leaves decision block 812 by the YES output, and proceeds to a further decision block 816, which represents a determination as to whether the primary pump status as recorded in internal memory is "FAILED." If the status is FAILED, the logic leaves decision block 816 by the YES output, and proceeds directly to a block 818, which represents immediate transmission over the network of the message "PRIMARY FAILED." If the memorized recorded status is not FAILED, the logic leaves decision block 816 by the NO output, and proceeds to a decision block 820. Decision block 820 determines if the system goal is met or satisfied. In the context of a heat exchanger as the fluid using or affecting device, the goal may be, for example, the existence of a minimum fluid flow at either port of the fluid affecting device, or a temperature below a given threshold value, which in turn might be dependent upon a fluid flow rate. If the goal has been or is currently met, the logic leaves decision block 820 by the YES output, and proceeds to a block 822. Block 822 represents the setting of the status of the associated pump to OFF, which is accomplished by deenergizing the pump. This makes sense, as the primary pump should not be operating if there is no demand for fluid. From block 822, the logic proceeds to a block 824, which represents the sending of a status message PRIMARY OFF over the network. The logic will traverse decision blocks 816 and 820, and blocks 822 and 824, during each iteration through the logic of FIG. 8, so long as the pump is primary and the status is NOT FAILED. It would also be possible to put these blocks into a separate logic loop, independent of the remainder of the logic, to provide a continuous monitoring of the status of the pump.

In FIG. 8, the logic leaves decision block 820 by the NO output if the goal has not been met (that is, if there is fluid flow or pressure demand), and the logic then arrives at a block 826. Block 826 represents the setting of the associated pump status to ON, which means simply applying power to the motor of the associated pump. This makes sense, as the primary pump should be in operation if the demand has not been met. Block 828 represents the sending of the message PRIMARY ON over the network to the other equipments, including the other (secondary) pumps.

Once the primary pump is in operation, the logic of FIG. 8 flows from the block 828 to a decision block 830. Decision block 830 determines the actual operation status of the associated pump. While the pump should be in operation if energized as commanded by block 826, it might have open windings, a seized bearing, or other malfunction which results in no actual pumping of fluid. The fact of operation can be readily determined by an output flow sensor or pressure sensor, or both. These may be integrated into the associated pump, so that the network is not needed to communicate with the sensors, or they may be separate units which communicate with the associated pump controller by way of the network 70. If the associated pump is not confirmed to be operating by such conventional decision-making, the logic leaves decision block 830 by the NO output, and flows to a block 832. Block 832 represents the setting of the status of the associated memory to FAILED, and the logic then reaches block 818, which sends the status message PRIMARY FAILED. There are several ways to handle the logic after block 818. One way is to shut down the pump controller logic except for those portions providing responses to inquiries. When the device is repaired, the status flag would have to be re-set to NOT FAILED, and pump could then be returned to the pool of secondary pumps.

If the associated pump is determined to be pumping in response to the conventional tests in FIG. 8, the logic leaves decision block 830 by the YES output. From the YES output of decision block 830, the logic arrives at a decision block 834. Block 834 determines if the associated pump and program are connected to the network. This determination is made by simple techniques such as deeming the status to be CONNECTED if signals are received at the network input port of the processor running the program of FIG. 8. More sophisticated techniques may be used, such as sending messages to other units of the network requesting replies. If block 834 determines that the pump and program are connected to the network, the logic leaves by the YES output, and returns by way of a path 835 to decision block 812. On the other hand, if decision block 834 determines that connection to the network has been lost or at least is not established to be present, the logic leaves decision block 834 by the NO output. The lack of signals at the network port does not necessarily indicate that the network is not connected, as signals may not be received during the first iteration of the logic of the program of FIG. 8, since all other devices may be in a start-up phase of operation and not sending signals. Thus, the program of FIG. 8 must operate somewhat differently during the initial or start-up phase of operation. From the NO output of decision block 834, the logic flows to a decision block 836. Block 836 determines if the current iteration is the first iteration, accomplished in well-known manner by examining the setting of an initial flag. If the current iteration is the first iteration, the logic leaves decision block 836 by the YES output, and proceeds by way of a flag-resetting block 838 and by path 835 back to decision block 812. On the other hand, if the current iteration is the second or later iteration, the logic leaves decision block 836 by the NO output, and arrives at a decision block 840. Decision blocks 840 . . . 842 together represent evaluation of the last-known context in which the system as a whole was operating. For example, if network communications are lost during a time at which the ship is at dockside during peacetime, it may not make sense to do anything at all to the associated pump during loss of communication. The state or context is determined by an examination of a context memory (not explicitly illustrated) by decision block 840. If the status is found to be peacetime dockside, decision block 840 routes the logic by way of its YES output to a block 844, representing setting the status of the associated pump to OFF if it is not already off. Such an action may prevent flooding by comparison with a situation in which fluid flow support is provided for a system (the context being peacetime and dockside) which is not energized. If the context is other than peacetime dockside, other decision blocks (not illustrated) may result in other actions. The last decision block in the string, namely decision block 842, represents a last known context of BATTLE. In the event that the logic reaches decision block 842 under a BATTLE condition, the logic is routed to its YES output and to a block 846. Block 846 may represent, for example, the turning ON of the associated pump on the assumption that battle-critical equipment requires the resource, even though communication with the network has been lost. From either of blocks 844, 846, or any other like block, the logic flows to a block 848, representing the (possibly only attempted) sending of status message over the network. The logic then returns to block 810 by way of a return logic path 849.

FIG. 9 represents another portion of the logic or a continuation of the logic of FIG. 8, and thus both the logic flows of FIGS. 8 and 9 operate in conjunction with just one associated pump. As described above, the logic associated with FIG. 8 reaches node A at startup if the associated pump is not deemed to be the primary pump. The logic flow enters the flow diagram of FIG. 9 from node A, representing the beginning of the logic flow for a secondary pump, which is to say a pump in which the internal memory of the associated controller or program deems it to be secondary (or at least not-primary). From node A of FIG. 9, the logic proceeds to decision block 910. Decision block 910 determines if a PRIMARY FAILED message has been received. This is performed by simply placing such a message into memory when it is received, and retrieving the message from memory, if it is present, in response to arrival of the logic at decision block 910. If the primary pump is not failed as indicated by a lack of a PRIMARY FAILED message, the logic leaves decision block 910 by way of the NO output, and returns by way of a node C to block 812 of FIG. 8. On the other hand, if the primary pump is reported as having failed, the logic leaves decision block 910 by the YES output, and the logic flows to a block 912. Block 912 represents the starting of a random-interval timer. The purpose of the random timer is to distinguish among the many currently-secondary pump/program combinations which might potentially assume primary status if the primary pump has failed. In order to prevent all of the potential secondary pumps from attempting to become primary, only that one of the secondary pumps in which the count of the random timer first expires or reaches zero is allowed to become primary. This is accomplished by the logic of decision blocks 914 and 916. More particularly, during the interval in which counter 912 is counting down, decision block 914 looks for an "I AM PRIMARY" message from the network. If such a message is received before the expiry of the count of counter 912, this means that some other pump in the fluid system has assumed primary status, and the pump associated with this version of the logic need not assume such status. The logic leaves decision block 914 by the YES output in such a situation, and proceeds to node C. By returning to node C and returning to decision block 812 of FIG. 8, the associated pump remains in the "SECONDARY" state or condition. On the other hand, if no "I AM PRIMARY" message is received before the expiry of the count of the counter 912, the logic leaves decision block 914 by the NO output, and proceeds to decision block 916. From decision block 916, the logic flows to block 918, which deems the associated pump to be primary, and sets the associated status in local memory to PRIMARY. From block 918, the logic flows to a block 920, which sends an I AM PRIMARY message over the network, to thereby maintain all the other secondary-status pumps in secondary state. From block 920, the logic returns by way of node B to decision block 820 of FIG. 8.

In the context of the fluid system of FIG. 7, there is but a single secondary pump, and the logic of FIG. 9 must flow to block 918, as the lack of other secondary pumps means that there will never be another message I AM PRIMARY before the expiry of the count of counter 912. Thus, the random-number scheme of FIG. 9 is not particularly useful where there is but a single secondary pump.

It should be noted that the random-interval scheme of FIG. 9 for selection of the next pump to be the new primary pump is not necessary, but is rather merely one possible nicety. Other schemes could be used to select that one of the secondary pumps to be the new primary pump if the primary pump fails, and one of the criteria might be selection of the most-used pump, or the least-used pump, based upon historical records of time in actual pumping service, and also depending upon the theory by which such determinations are made. FIG. 10 represents an alternative logic flow which can replace that of FIG. 9. In FIG. 10, the logic arrives from node A at decision block 910, which performs the same function as in FIG. 9. If the primary is not failed, the logic leaves decision block 910 by the NO path, and proceeds to node C, as described in conjunction with FIG. 9. If the primary pump is in a failed state, the logic leaves decision block 910 by the YES output, and arrives at a further decision block 1010, which determines if the associated pump is the one with the lowest (or highest, if desired) number of hours. This is accomplished by simply ranking the stored information relating to hours of use of the various pumps in ascending or descending order. If the associated pump is the highest-or lowest-ranked so that the associated pump is to be selected to be primary, the logic leaves decision block 1010 by the YES output, and proceeds to blocks 918 and 920, corresponding to those of FIG. 9, and thence to node B, having declared the associated pump to be primary. If the associated pump is not the highest-ranked, some other pump is highest-ranked, and should send its own I AM PRIMARY message. It could happen that the next-ranked pump could be totally destroyed, which could result in the logic waiting for the occurrence of an I AM PRIMARY message which would never arrive. If decision block 1010 finds that the associated pump is not the highest- or lowest-ranked, the logic leaves by the NO output, and arrives at a block 1012, which determines the rank (x) of the associated pump among all the other available secondary pumps (Y). This establishes how many potential secondary pumps would sequentially attempt to become primary before the current one should assert itself as primary. For this purpose, an internal timer 1014 is set to a time interval x(t), where t is some interval deemed to be sufficient for a secondary pump to assert its primary nature. Thus, if the associated pump were the third-ranked of four secondary pumps, the time interval set on the associated timer would be 3*t*, where t might be 1 millisecond. From block 1014, the logic then proceeds to a block 1016, which starts the timer. At the expiry of the time period, the logic enters decision blocks 914 and 916, which coact by means of a path 917 as described in conjunction with FIG. 9, to route the logic to node C if a I AM PRIMARY message is received before the expiry of the timer count, and to route the logic to blocks 918 and 919 if the count expires before such a message is received. Thus, the various secondary pumps can sequentially attempt to assert themselves as primary if the current primary pump fails.

As described in the Hoyle et al. Ser. No. 09/654,732 application, the pumps need not be in the same housings as the flow meters, or may be in the same housings. The pressure meters may or may not be used, as desired. Various types of interconnecting networks may be used, including twisted-pair, cable, optical fiber, or even wireless. The particular implementation of the experimental units used copper twisted-pair wires running the LonWorks protocol. The particular logic processors were Neuron processors, a technology of Echelon Corporation of Palo Alto, Calif., but other processors may be used. While in the described embodiments the fluid affecting devices are heat exchangers, they could be chemical reaction devices, so long as the flow rates of the reactants and the reaction products are known and accounted for. While the networks are illustrated as a discrete blocks, it will be recognized that this as a mere convention to illustrate a distributed system without any central processing, at least as to pump or valve control, although of course a shipboard communications network may be associated with, or "have" centralized control of many aspects of the ship's operation other than that of details of the operation of each individual valve or pump. While the descriptions are couched in terms of the pumps creating positive pressure at the fluid affecting device, negative pressure (partial vacuum) may also be used, whereupon the fluid flow is retrograde. The pumps may be single-stage or multiple-stage, and the pump controllers may change pump speed in a stepwise- or continuously-variable manner instead of simply energizing for full speed operation and de-energizing for zero speed. As a further alternative to selection of the secondary pump which is to become primary, the pump control logic could be arranged to select a new primary pump when the current primary pump has run a predetermined number of hours, thus tending to equalize the usage among the available pumps.

Further improvements are desired in autonomous control of fluid systems.

SUMMARY OF THE INVENTION

A heat pump assemblage according to an aspect of the invention includes an independent controller associated with one heat pump assemblage, which is capable of operation in conjunction with a plurality of such heat pump assemblages and in the presence of a network linking the heat pump assemblages. Each heat pump assemblage includes a powered heat pump for pumping heat from one of a controlled environment and a heat sink to the other one of a controlled environment and a heat sink. Thus, the powered heat pump may be an air conditioner, for example, pumping heat from a room to the exterior environment, to keep the controlled environment cool, or it may be a heat pump operating to pump heat from the exterior environment to heat the room. In either case, the room is the controlled environment. Of course, instead of a room, a heat exchanger could be used to heat or cool an equipment cabinet or a particular piece of equipment by use of air, water, or any fluid heat exchange medium. The power for the powered heat pump may be electrical or mechanical, as for example power may be from an electrical motor controllable in response to an electrical control signal, or from a water wheel including a controllable clutch responsive to a control signal. The heat pump assemblage also includes a controller unique to the heat pump assemblage, for generating the control signal for controlling the powered heat pump. The controller includes a memory flag (and thus necessarily a memory for such information) indicative of the primary or secondary status of that heat pump assemblage with which it is associated. The controller also includes a communication port and memory (or further memory portion) for receiving and at least temporarily storing at least one of (a) a temperature indication signal indicative of temperature of the controlled environment and (b) a humidity indication signal indicative of humidity of the controlled environment. Thus, it is contemplated that the heat exchanger may be for controlling the temperature of the controlled environment or the humidity thereof, or possibly both. The controller determines the primary or secondary status of the associated heat pump assemblage by examining the memory flag and, if the status is primary, starts the associated powered heat pump in response to a comparison of one of (a) the temperature of the controlled environment as represented by the temperature indication signal and (b) the humidity of the controlled environment with a predetermined set point stored in memory. The set point can be received by way of the communication port, or possibly by a local controller, such as a keyboard andor knob. On the other hand, if the status is secondary, the associated powered heat pump in started in response to a comparison of the one of (a) the temperature of the controlled environment as represented by the temperature indication signal and (b) the humidity of the controlled environment as represented by the humidity indication signal with another set point (also preferably received by way of the communication port), where the values of the first and second set points may be equal. Thus, in these manifestations of the invention, the controllers independently control their heat exchangers substantially independently of each other.

In another avatar of the invention, a heat pump assemblage includes an independent controller capable of operation in conjunction with a plurality of such heat pump assemblages and in the presence of a network linking the heat pump assemblages. The or each heat pump assemblage includes a powered heat pump for pumping heat from one of a controlled environment and a heat sink to the other one of a controlled environment and a heat sink. The power for the powered heat pump, whether electrical or mechanical, is controllable in response to a control signal. The heat pump assemblage includes a controller unique to the heat pump assemblage, for generating the control signal for controlling the associated powered heat pump. The controller includes a memory flag indicative of the primary or secondary status of that heat pump assemblage with which it is associated. The controller also includes a communication port for receiving at least one of a temperature indication signal and a humidity indication signal indicative of temperature or humidity, respectively, of the controlled environment. In operation, the controller determines the primary or secondary status of the associated heat pump assemblage by examining the memory flag and, if the status is primary, starts the associated powered heat pump in response to a comparison of the temperature of the controlled environment as represented by the temperature indication signal and (or with) a predetermined set point, which may be received by way of the communication port. If the status is secondary, the associated powered heat pump is started in response to the rate of change of the temperature of the controlled environment as represented by the temperature indication signal and the humidity indication signal indicative of temperature or humidity, respectively, or possibly of both, of the controlled environment signal, with the determination being made after a signal is received indicative of operation of at least one other heat pump assemblage. In general, this allows operation of a particular one of the secondary heat exchanger(s) to be delayed or avoided during any cycle if the rate of change of the controlled variable (temperature or humidity) in response to that one (or those) heat exchanger(s) already operating is sufficient.

DESCRIPTION OF THE INVENTION

Figure 1:
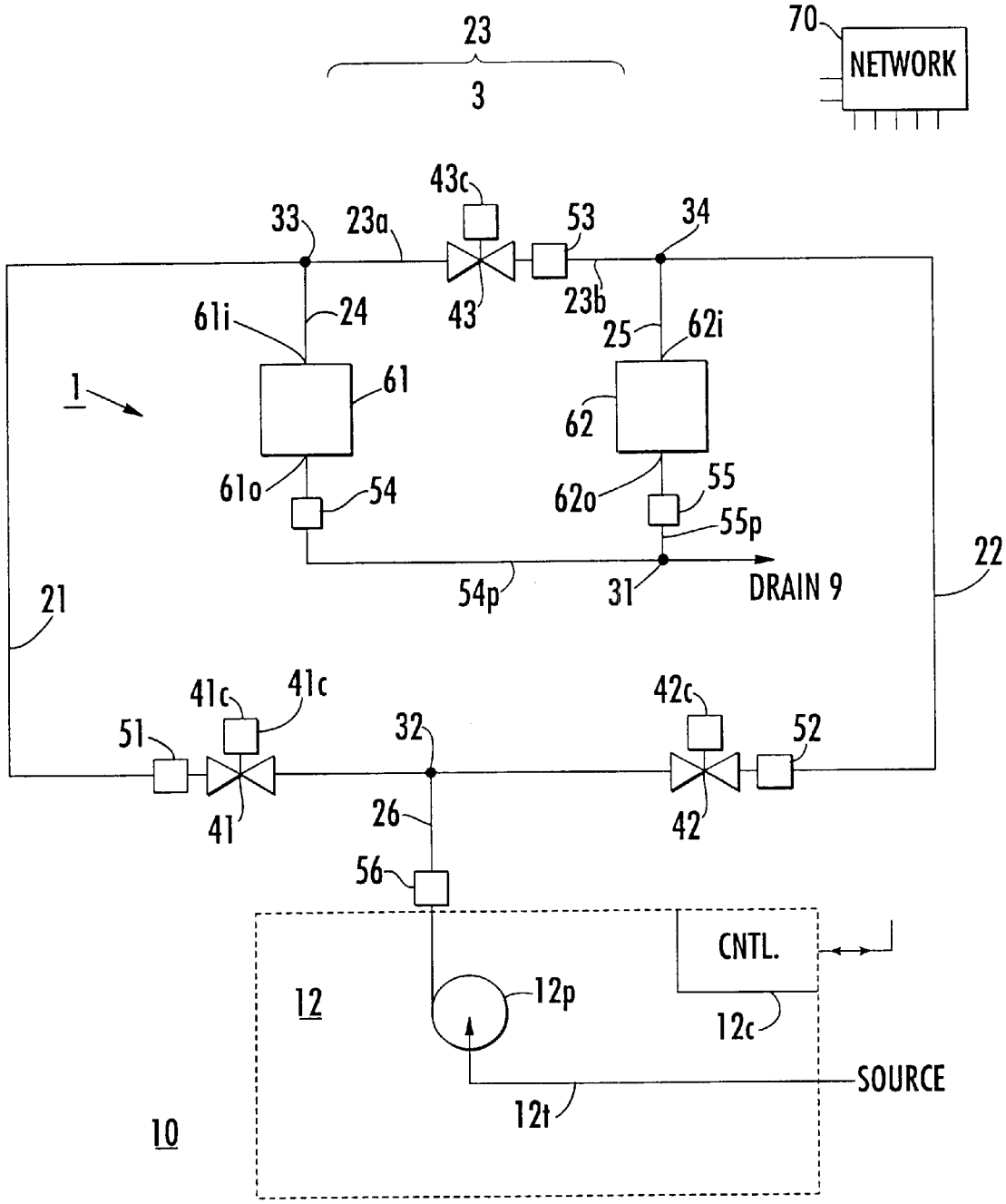
FIG. 1 is a simplified block diagram of a fluid flow or distribution system for distributing fluid from a source to one or both of a pair of flow utilization devices, substantially as described in U.S. patent application Ser. No. 09/608,829, filed Jun. 30, 2000.
Figure 2:
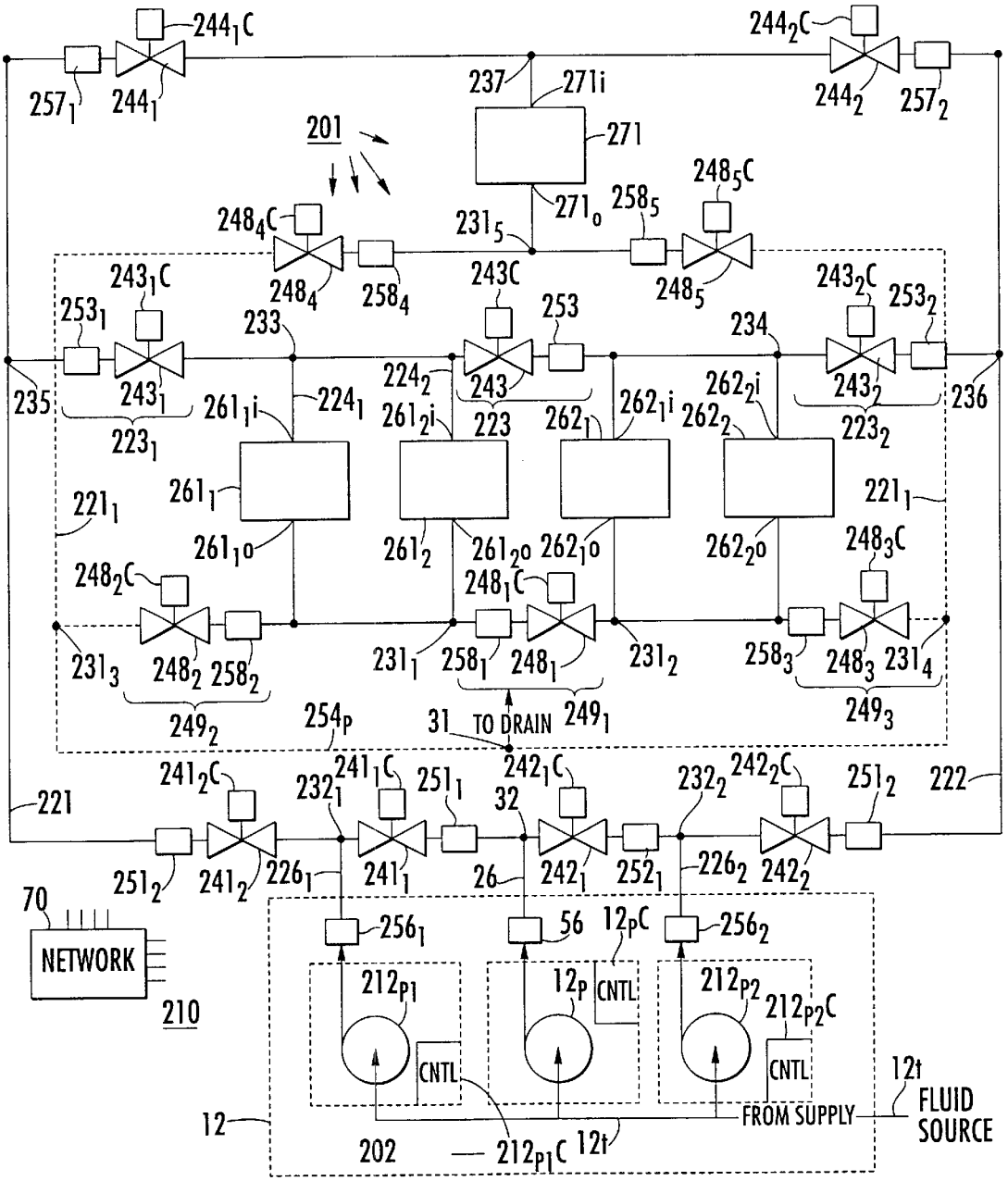
FIG. 2 is a simplified block diagram of a fluid flow or distribution system for distributing fluid from a plurality of sources to a plurality of flow utilization devices, also substantially as described in the abovementioned patent application.
Figure 3:
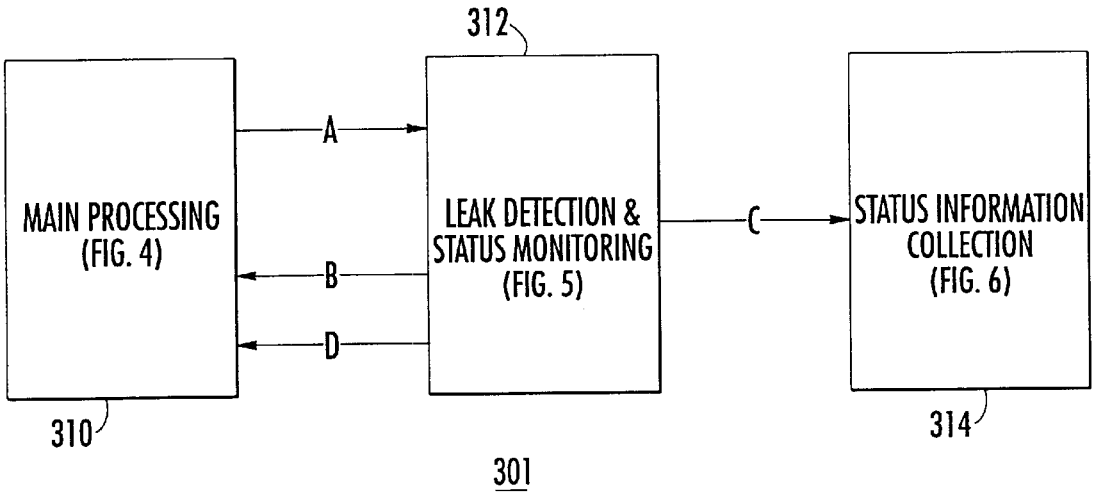
FIG. 3 is a simplified block representation of various software or logic portions which are associated with each valve of the arrangement of FIGS. 1 or 2 for autonomously controlling the valve.
Figure 4:
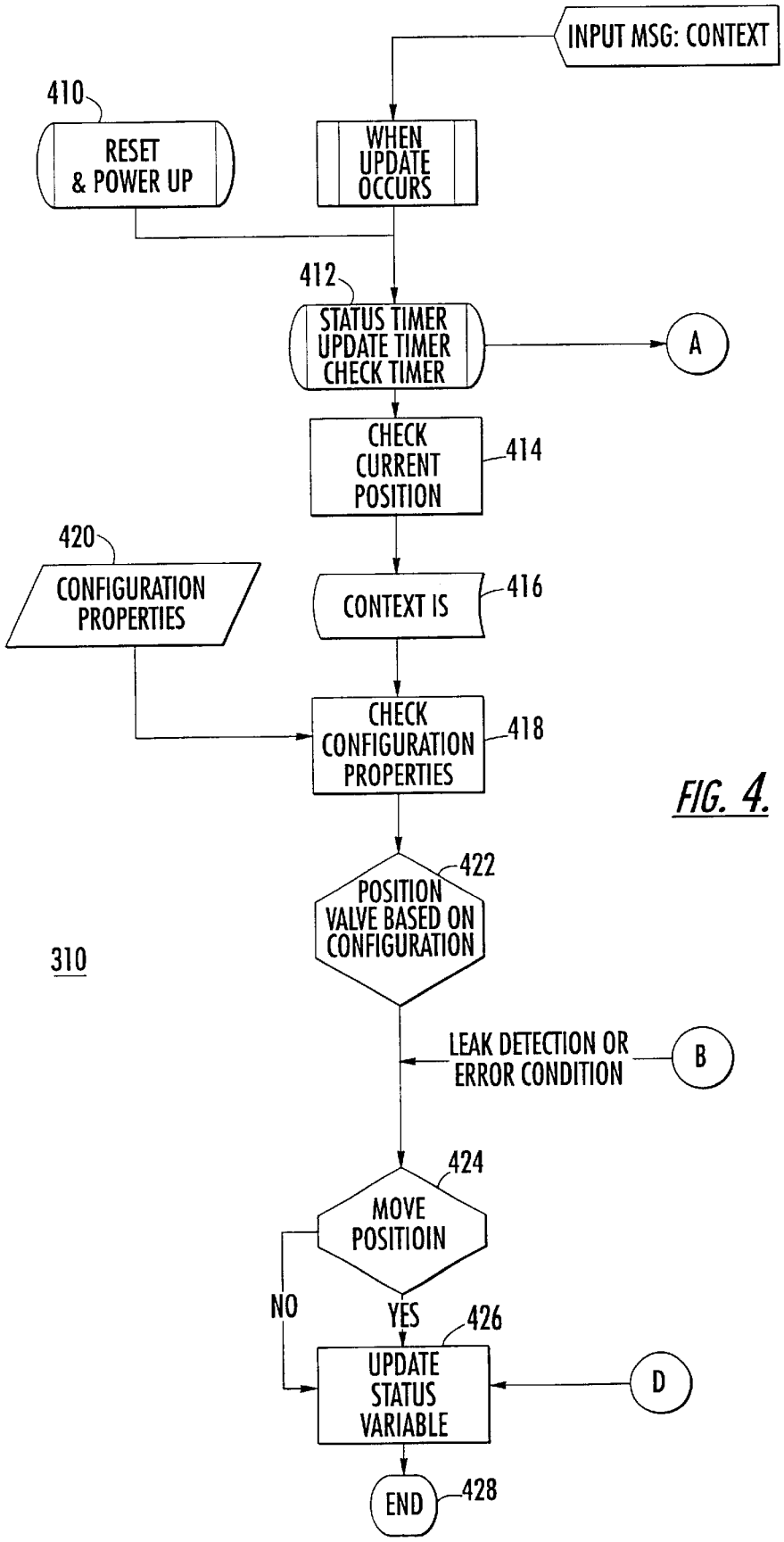
FIG. 4 is a simplified block representation of a logic flow chart or diagram of a portion of FIG. 3.
Figure 5:
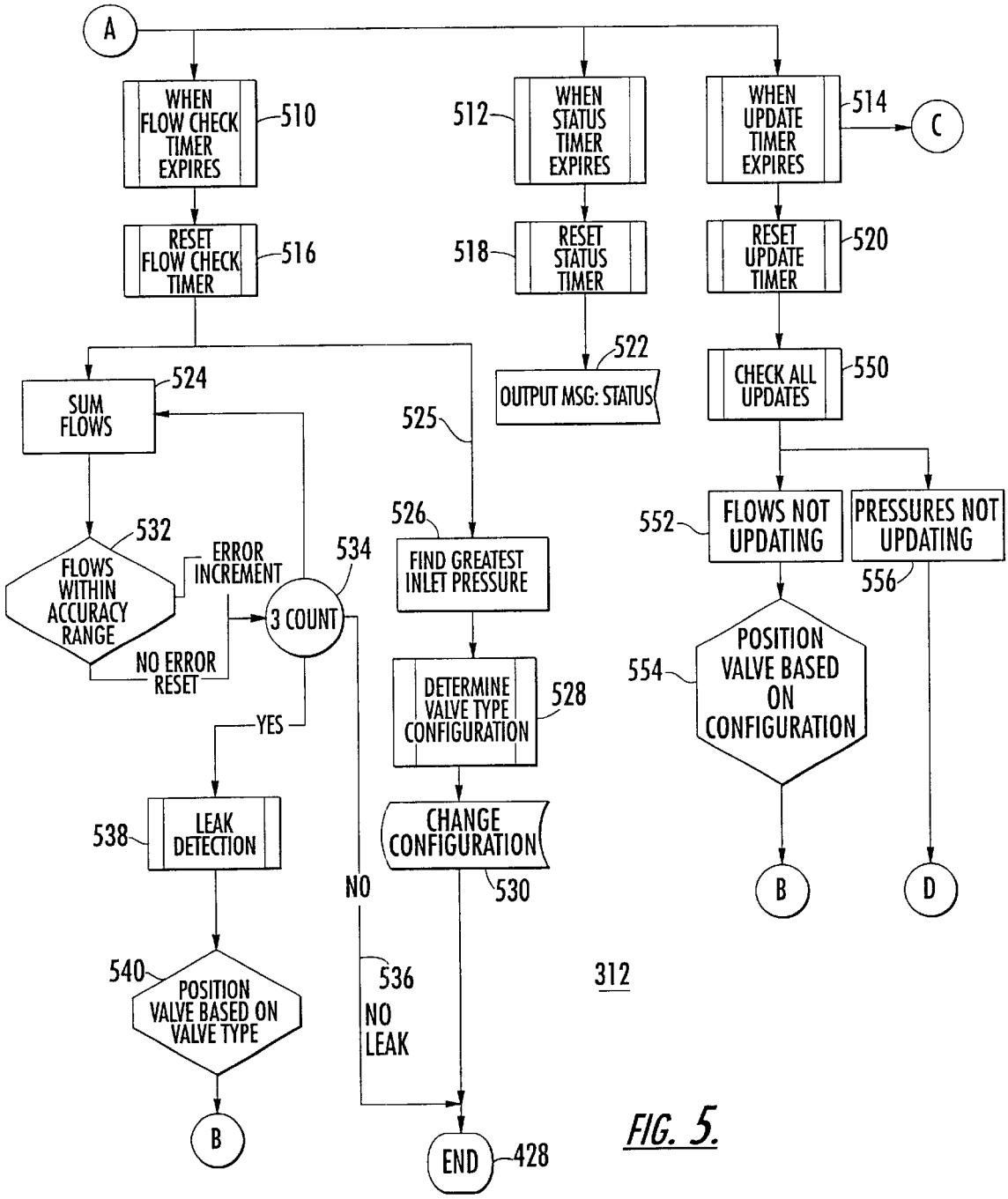
FIG. 5 is a simplified block representation of a logic flow chart or diagram of another portion of FIG. 3.
Figure 6:
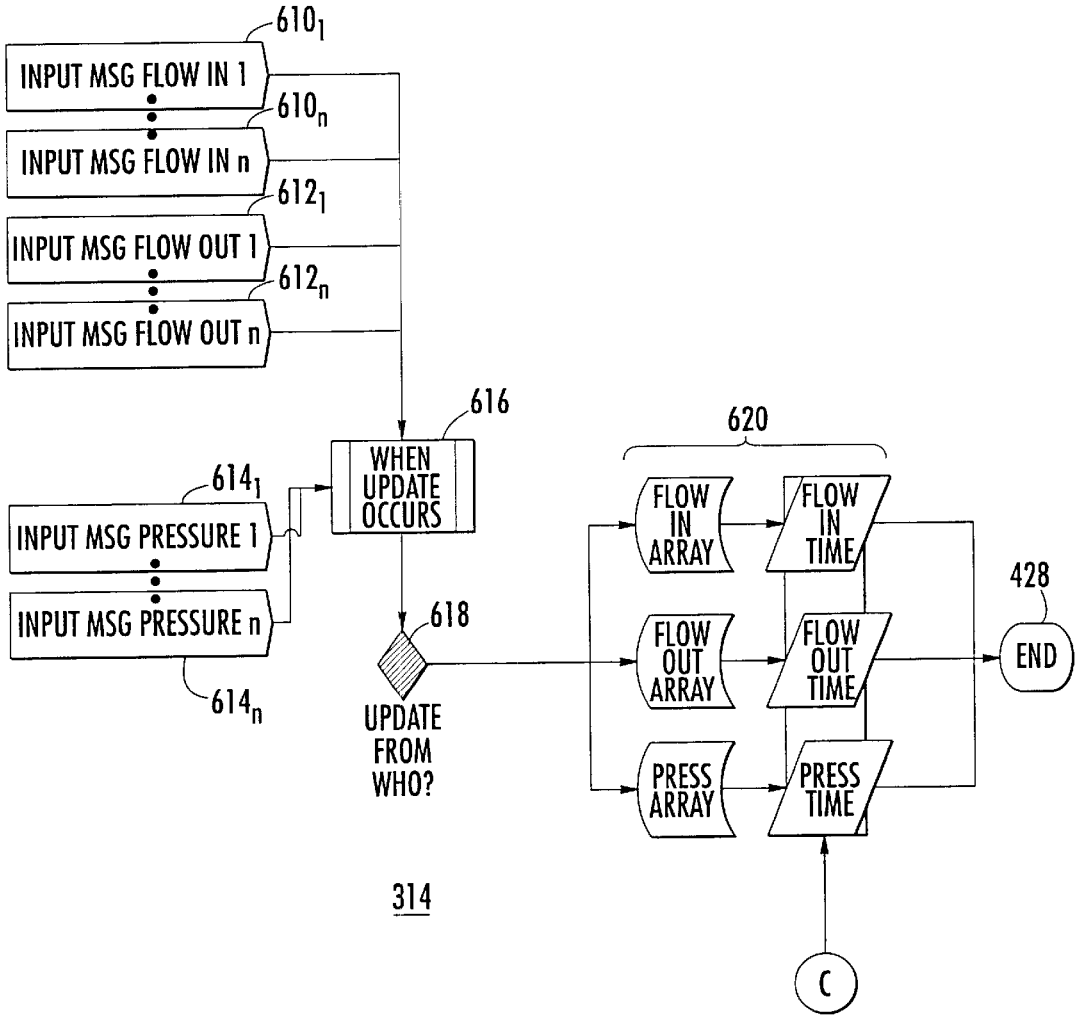
FIG. 6 is a simplified block representation of a logic flow chart or diagram of another portion of FIG. 3.
Figure 7:
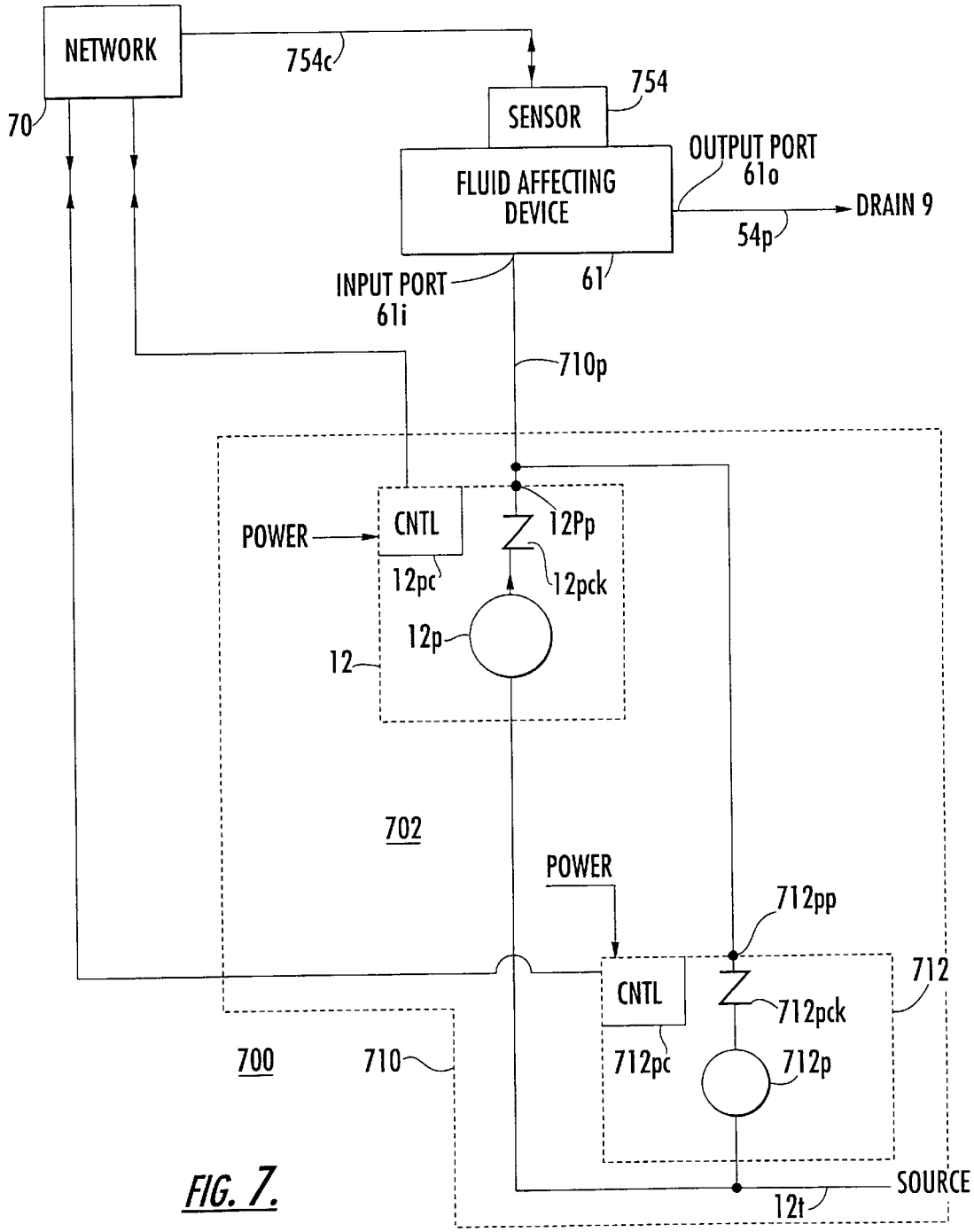
FIG. 7 is a simplified block diagram of an arrangement according to U.S. patent application Ser. No. 09/654,732, filed Sep. 5, 2000, in which a pair of controllable pumps supply fluid to a fluid affecting device.
Figure 8:
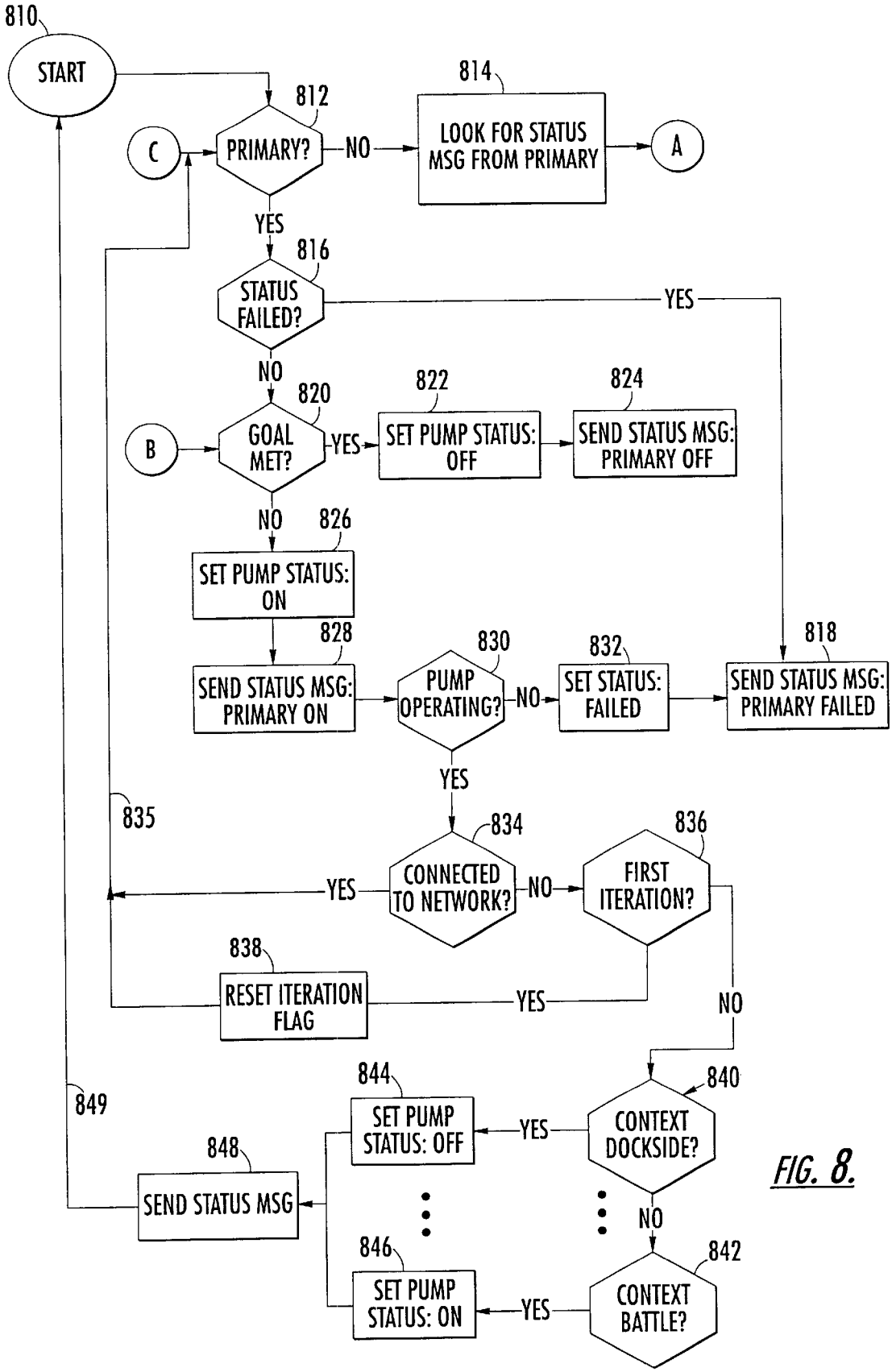
FIGS. 8 and 9 together constitute a simplified flow chart or diagram of the independent logic associated with each pump of a fluid system.
Figure 11:
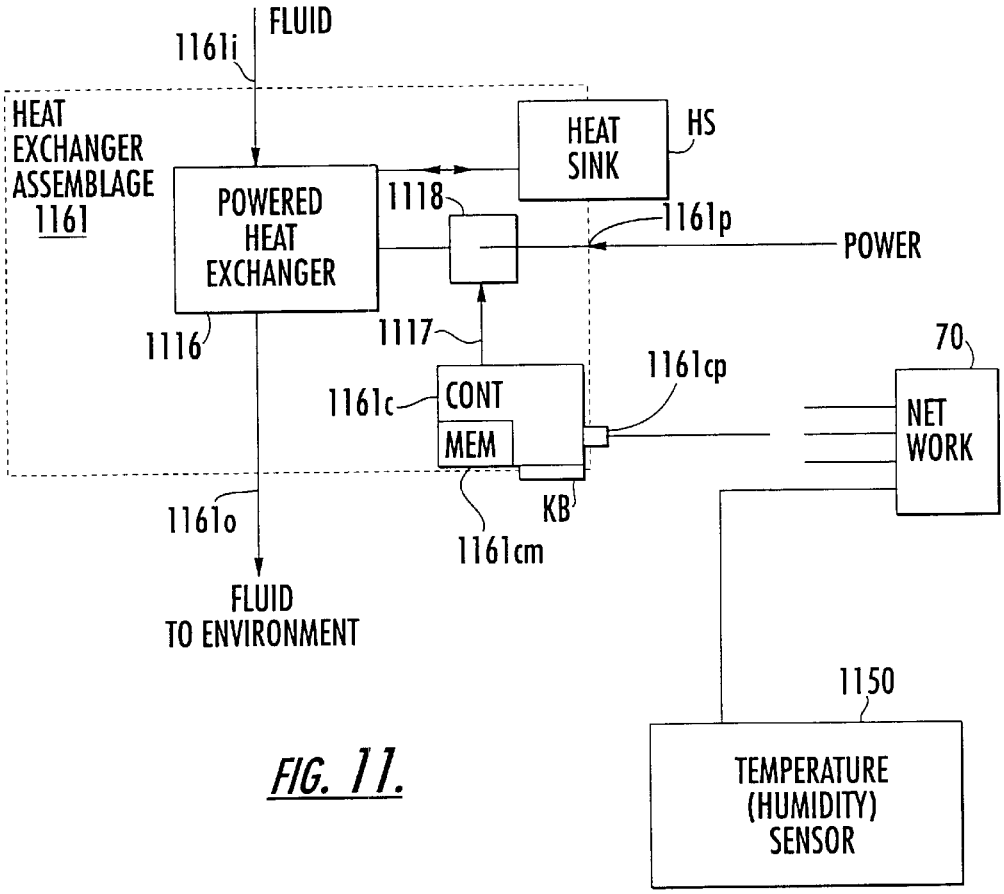
FIG. 11 is a simplified representation of a heat exchanger assemblage according to an aspect of the invention, which can be used as one or more of the heat exchangers or other fluid affecting devices of FIGS. 1, 2, or 7.

In FIG. 11, the heat exchanger assemblage 1161 includes a fluid input port 1161*i* and a fluid output port 1161*o*. The heat exchanger assemblage also includes an associated controller (CONT) illustrated as a block 1161*c*, which controls the application of power from a power input port 1161*p* to an actual powered heat exchanger 1116, as for example by way of an electrical contactor (switch) or mechanical clutch illustrated as a block 1118. Controller 1161*c* includes a network port 1161*cp* by which connection can be made to network 70 of FIGS. 1, 2, or 7. FIG. 11 also illustrates a network temperature sensor 1150 which is coupled to the network 70 for sending signals over the network representative of the temperature (or possibly humidity) of the environment controlled by heat exchanger 1161 and possibly other such heat exchanger assemblages. It should be noted that the temperature itself is broadcast over the network, not a binary (two-level or on-off) signal representing the difference between a set temperature and the environmental temperature, as in a conventional thermostat. In general, controller 1161*c*, during operation in a fluid network such as that of FIGS. 1, 2, or 7, receives at various times from the network 70 information relating to the context (dockside, battle, etc. or its equivalent in other contexts), its location in the fluid network, its initial assigned status as primary or secondary, and other like preprogrammed information for storage in internal memory such as memory 1161*cm*. Normal operation of the heat exchange assemblage includes conditions or times in which the powered heat exchanger 1116, under control of controller 1116*c*, is both operating and nonoperating. Operation of each heat exchange assemblage 1161 includes the pumping of heat between a heat sink HS and a heat exchange medium such as fluid flowing in a path between ports 1161*i* and 1161*o*. When operated in a cooling mode, heat is pumped from the fluid to the heat sink, and in a retrograde direction for heating. The controlled environment is coupled to the fluid flow or to the heat sink. During operation in a system including plural heat exchanger assemblages, in a system in which plural heat exchanger assemblages similar to 1116 of FIG. 11 are providing heat exchange for a particular controlled environment, one heat exchanger assemblage may be operating, and another may be idle at any particular time, depending upon the temperature of the controlled environment as sensed by one or more temperature sensors measuring the environment. Each heat exchanger assemblage 1161 in such a system determines for itself, based on its autonomous controller 1161*c*, whether to operate in a heat-exchange mode or not. Thus, failure of a "primary" heat exchanger assemblage may cause one or more "secondary" heat exchanger assemblages to begin heat exchange, even though the sensed temperature has not changed, because the network distributes the "failed" status of the primary heat exchanger assemblage to all the secondary heat exchanger assemblages, each of which then decides whether or not to operate. Alternatively, secondary heat pumps may autonomously decide to turn on notwithstanding that the primary heat pump is operating, as for example if the temperature should deviate from the setpoint of the primary heat point, or if the rate of change of the controlled characteristic should move the characteristic toward a second setpoint. At turn-on, if the rate of change of the temperature toward the set temperature is deemed to be sufficient with the current number of heat exchanger assemblages in operation, a further heat exchanger assemblage may decide to remain quiescent, whereas an insufficient rate of change may result in a different decision. If the rate of change of temperature of the controlled environment away from the set temperature exceeds a particular rate, one or more of the autonomously controlled heat exchanger assemblages may be operated to slow or reverse the rate of change.

Figure 12:
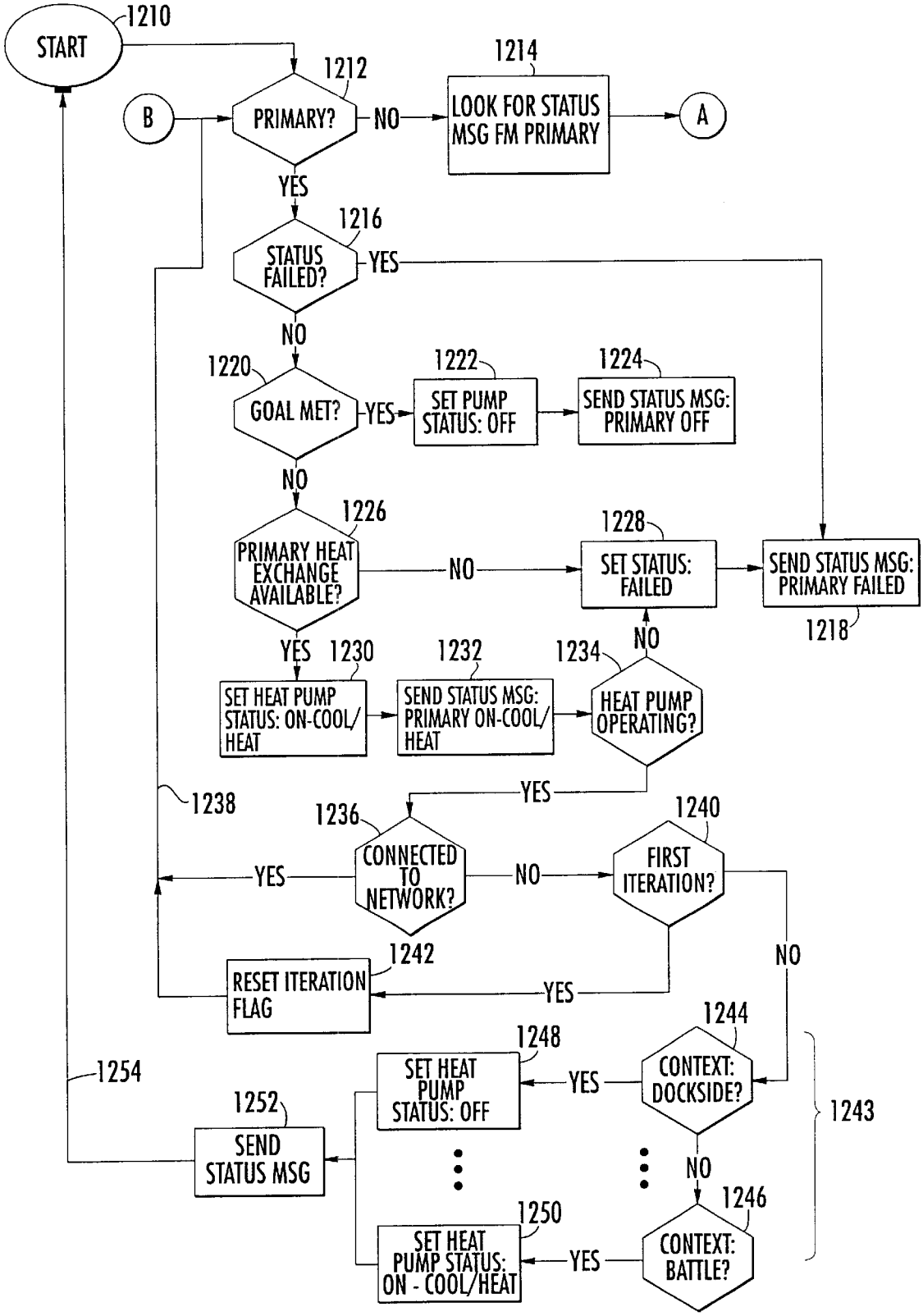
FIG. 12 is a simplified logic flow chart or diagram, illustrating the principles of control according to an aspect of the invention in an arrangement similar to that of FIG. 11.
Figure 13:
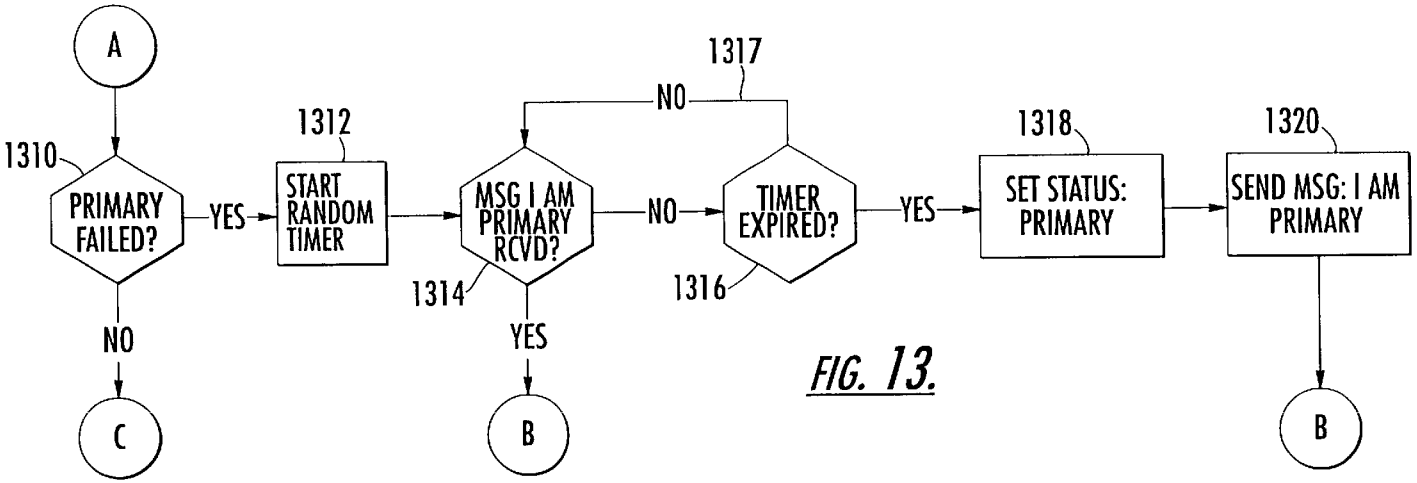
FIG. 13 is a simplified flow chart or diagram, similar to FIG. 9, illustrating logic for determining if the associated heat exchanger should switch from the SECONDARY state to PRIMARY.
Figure 14:
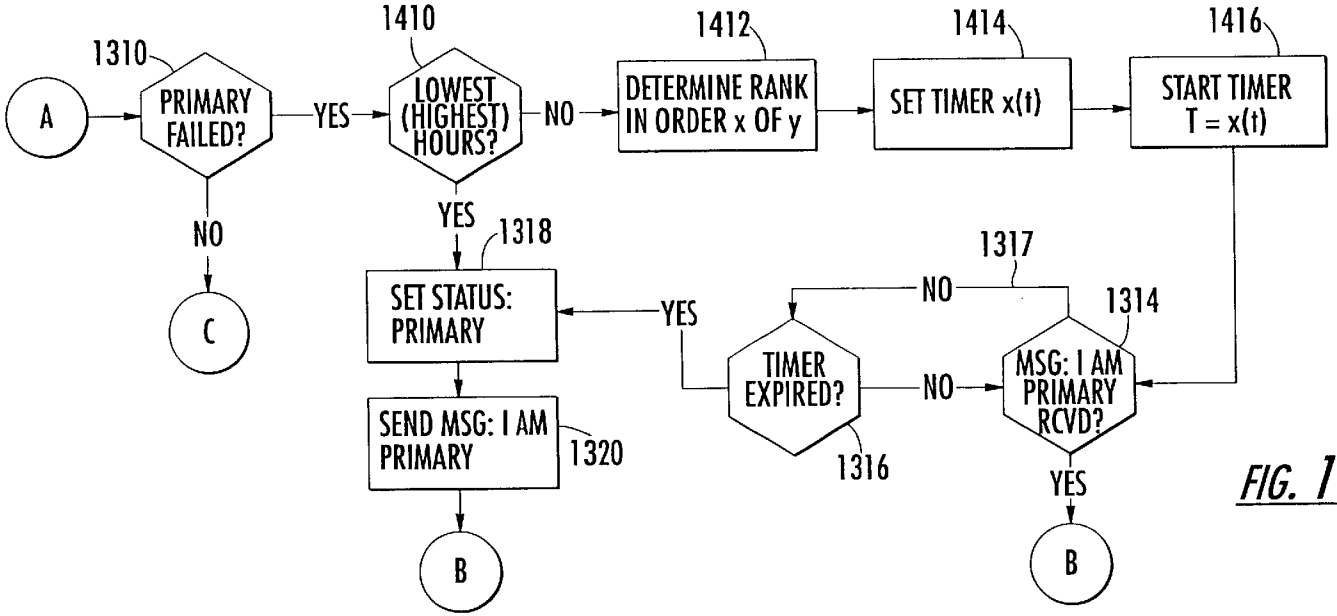
FIG. 14 is a simplified logic flow chart or diagram illustrating an alternative arrangement to that of FIG. 13 for changing the status of the associated heat exchanger from SECONDARY to PRIMARY.

More particularly, FIGS. 12, 13, and 14 illustrate portions of the autonomous logic associated with the heat exchange assemblage of FIG. 11, for interacting in a network context with other such heat exchanger assemblages. FIG. 12 is a simplified logic flow chart or diagram, illustrating some principles of control according to an aspect of the invention. In FIG. 12, the logic starts at a START block 1210, and proceeds to a decision block 1212, which examines an internal memory flag to determine if the associated heat exchanger is primary. If the flag indicates that the associated heat exchanger is not primary, the logic exits decision block 1212 by the NO output and flows, by way of a block 1214, to a logic node A. If the heat exchanger is primary, the logic leaves decision block 1212 by the YES output, and arrives at a further decision block 1216, which determines if the status of the associated heat exchanger is FAILED. If FAILED, the logic exits decision block 1216 by the YES output, and flows directly to a block 1218, which represents the sending of a PRIMARY FAILED status message over the network.

If the logic arrives at block 1218 of FIG. 12, the heat pump would be deemed to be inoperative, and would require some sort of service. It would be desirable to place all "failed" messages and put them in a maintenance queue. Part of the service of the failed heat pump would be to restart or reset the logic. It is possible that there might be different types of failures. If the failure was a performance characteristic, say high current draw of the motor or low delta T across the heat exchanger, the unit could be placed in an emergency reserve status where it could be used if the context warranted operating an off spec heat pump. In this case the logic could return to start block. The logic for handling the emergency reserve status is not illustrated. If the failure were debilitating, as for example, the motor for the compressor is inoperative, then it would not be useful for the logic to continue operating, since there is no hope of the unit operating.

If decision block 1216 of FIG. 12 finds that the associated heat exchanger is operating properly, the logic exits by the NO output, and arrives at a decision block 1220. Decision block 1220 compares the sensed signal representing the controlled variable (the temperature or humidity, for example) arriving (or received) over the network with the set value stored in memory. This set value may be locally programmed into the memory, or is more desirably remotely settable by instructions received over the network. If the goal has been met, the logic leaves decision block 1220 by the YES output, and arrives at a block 1222. Block 1222 represents the turning OFF of the powered heat exchanger 1116 of FIG. 11. From block 1222 of FIG. 1224, the logic flows to a further block 1224, representing the sending of a PRIMARY OFF message over the network.

If the goal is found not to have been met in decision block 1220 of FIG. 12, the logic leaves the decision block by the NO output, and arrives at a decision block 1226, which represents a determination of the availability of an operational primary heat exchanger by examining the availability of primary heat-exchange (heating or cooling) fluid. This may be accomplished in various manners, depending on the configuration of the heat exchanger(s) and the heat sink(s) therefor. For example, if the primary heat exchanger is a simple finned pipe through which sea water circulates, the determination of the presence of heat exchange fluid could be accomplished by monitoring for the presence of seawater flow at the output of the pipe to verify that the appropriate fluid pump is operating. If the primary heat exchanger were air-cooled or air-heated, the flow of air might be monitored, or the rotation of a particular air-moving fan motor might be the criterion. One good criterion might be a pump motor load current lying within a particular range of values. It should be noted that this particular test may introduce some system delay, as compensation may have to be provided in the logic to account for the finite time it may take for the heat exchange fluid to reach the desired value after startup. If there is no availability of heat exchange fluid, the logic leaves decision block 1226 by the NO output, and arrives at a block 1228. Block 1228 is a representation of the deeming of the primary pump to have failed. From block 1228, the logic flows to block 1218, for sending a message indicative of the failure of the primary heat exchanger. In this case, the logic could return to the start block 1210, as the loss of cooling water could have been caused by a failure to a seawater service system. Since the heat pump wasn't really the cause of the fault, and it is reporting failed merely for self protection purposes, as soon as the sea water service system is restored, the heat exchanger is fully able to come on line. One can imagine a cascading fault through the system of the further secondaries, each trying to become primary, and each finding that there is no cooling medium. This eventuality could be contained by setting up a stop that would allow the system to restart when the flow is restored. However, such considerations are more directed to how a specific system would be designed to degrade.

Assuming that decision block 1226 of FIG. 12 finds that heat-exchange fluid is available, the logic flows by way of its YES output to a block 1230, which represents the energizing of the heat pump associated with the logic. In some cases, the heat pump will provide only cooling or only heating, so there is no need to specify which is to be performed. On the other hand, there may be situations in which the temperature may tend either above or below the setpoint, and in this situation an additional determination (not illustrated) must be made to determine the direction of heat flow through the heat exchanger. From block 1230, the logic flows to a block 1232, which represents the sending of a message over the network to the effect that the primary pump is ON and, if necessary, the direction of heat pumping. From block 1232, the logic flows to a further decision block 1234, which examines some criterion to determine if the heat pump is operating. If the heat pump is not operating notwithstanding the ON signal or state set in block 1230, the logic leaves decision block 1234 by the NO output, and flows to block 1228 to deem the associated heat exchanger as having failed, and to initiate the reporting of this status. This case would probably not be corrected until a serviceman had checked out the unit, and reset the failed flag as a last step of the repair.

Assuming that the heat exchanger began functioning properly following the turn-on decreed by block 1230 of FIG. 12, the logic leaves decision block 1234 by the YES output, and arrives at a further decision block 1236, which examines or checks the connection to the network. Such a check might be made by addressing a message to the network asking for a return message, and deeming the connection to be broken if no timely reply is received, or it might be made simply by noting the receipt of normal network traffic. If a connection to the network is deemed to be in place, the logic leaves decision block 1236 by the YES output, and propagates by way of logic path 1238 back to an input of decision block 1212 to start another logic iteration. If the network connection is deemed to have failed, the logic leaves decision block 1236 by way of the NO output, and flows to a further decision block 1240. Decision block 1240 determines whether the current iteration is the first iteration after start-up of the system by examining a start or iteration flag. At start-up, the flag is set. If the flag is set, the logic leaves decision block 1240 by the YES output, and arrives at a block 1242 representing resetting of the flag, so the flag will be NOT_FIRST_ITERATION on the next following iteration. From block 1242, the logic returns by way of path 1238 to decision block 1212. If the logic is on its second or a subsequent iteration, the flag of block 1242 will have been reset, and the logic will leave decision block 1240 by way of the NO output. From the NO output of decision block 1240, the logic flows to a first decision block 1244 of a cascade 1243 of decision blocks. Cascade 1243 compares the current context stored in memory with a plurality of different contexts, to determine what action is to be taken if the associated heat pump fails or if the network connection fails. As illustrated, cascade 1243 includes at least decision blocks 1244 and 1246. Decision block 1244 compares the current status flag to the "dockside" state, and decision block 1246 compares the current status flag with the "battle" state. The logic flows through cascade 1243, and departs from the cascade when the current state equals the state a decision block responds to. Under dockside conditions, the logic leaves decision block 1244 by the YES output, and flows to block 1248, which sets the associated heat pump to an OFF state. Under battle conditions, the logic leaves decision block 1246 by its YES output, and flows to a block 1250, which sets the heat pump ON to one or the other of "cool" or "heat" may be appropriate for battle conditions. From any of blocks 1248 or 1250, or any intermediate block, the logic flows to a block 1252, which represents the sending of a status message over the network. From block 1252, the logic returns by way of a logic path 1254 to the START block 1210. The status message is sent, notwithstanding the reporting failure of the network, on the possibility that the only incoming messages are blocked, and not outgoing messages.

Figure 9:
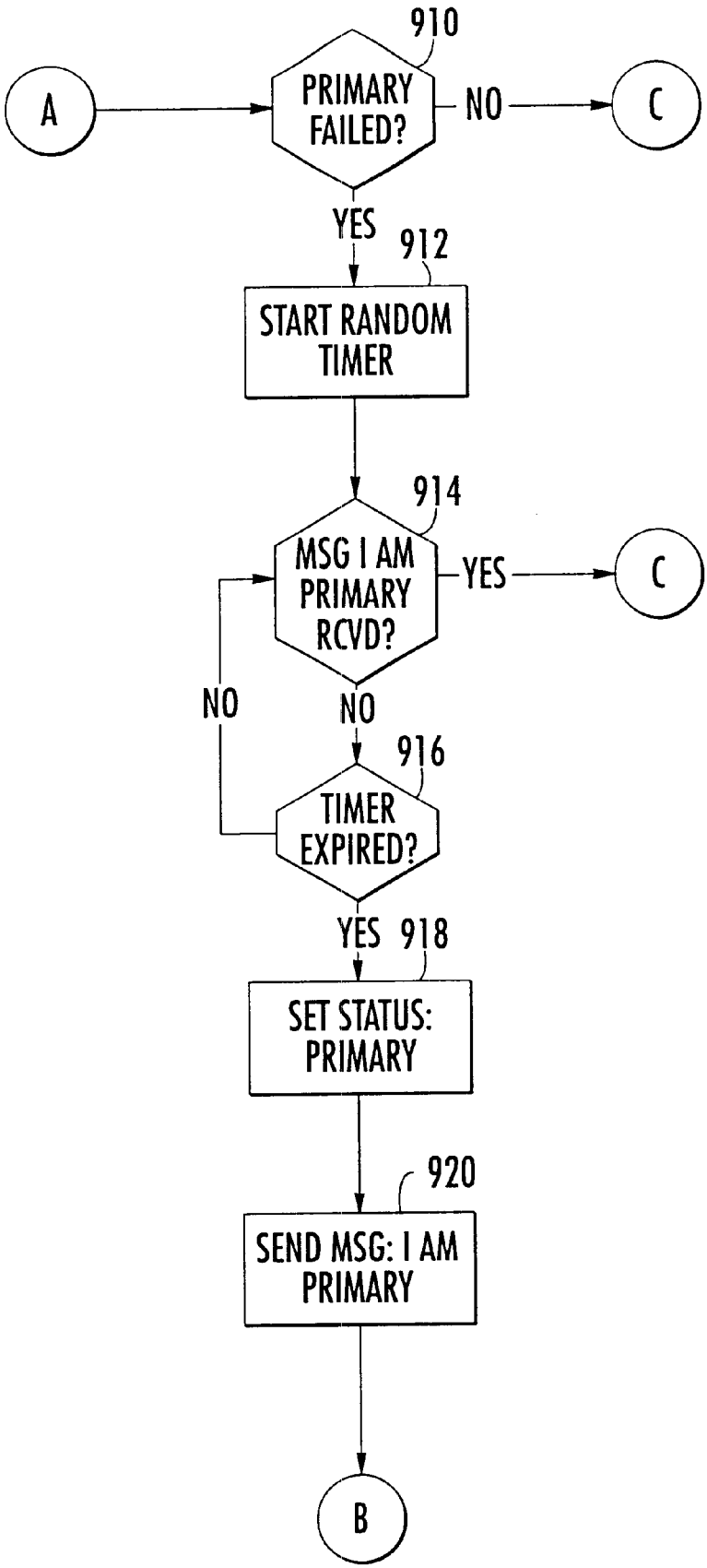

FIG. 13 is a simplified flow chart or diagram illustrating logic for determining if the associated heat exchanger should switch from the SECONDARY state to PRIMARY. The logic of FIG. 13 is generally similar to that of FIG. 9, and elements corresponding to those of FIG. 13 are designated by the same reference numerals in the 1300 series rather than in the 900 series. FIG. 13 represents another portion of the logic or a continuation of the logic of FIG. 12, and thus both the logic flows of FIGS. 12 and 13 operate in conjunction with just one associated heat exchanger. As described above, the logic associated with FIG. 12 reaches node A at startup if the associated heat exchanger is not deemed to be the primary heat exchanger. The logic flow enters the flow diagram of FIG. 13 from node A, representing the beginning of the logic flow for a secondary heat exchanger, which is to say a heat exchanger in which the internal memory of the associated controller or program deems it to be secondary (or at least not-primary). From node A of FIG. 13, the logic proceeds to decision block 1310. Decision block 1310 determines if a PRIMARY FAILED message has been received. This is performed by simply placing such a message into memory when it is received, and retrieving the message from memory, if it is present, in response to arrival of the logic at decision block 1310. If the primary heat exchanger is not failed as indicated by a lack of a PRIMARY FAILED message, the logic leaves decision block 1310 by way of the NO output, and flows to node C. On the other hand, if the primary heat exchanger is reported as being failed, the logic leaves decision block 1310 by the YES output, and the logic flows to a block 1312. Block 1312 represents the starting of a random-interval timer. The purpose of the random timer is to distinguish among the many currently-secondary heat exchanger/program combinations, one of which is the combination being described, which might potentially assume primary status if the primary heat exchanger has failed. In order to prevent all of the potential secondary heat exchangers from simultaneously setting themselves as primary, only that one of the secondary heat exchangers in which the count of the random timer first expires or reaches zero is allowed to become primary. This is accomplished by the logic of decision blocks 1314 and 1316 together with a path from the NO output of decision block 1316 to an input of decision block 1314. More particularly, during the interval in which counter 1312 is counting down, decision block 1314 looks for an "I AM PRIMARY" message from the network. If such a message is received before the expiry of the count of counter 1312, this means that some other heat exchanger in the system has assumed primary status, and the heat exchanger associated with this version of the logic need not assume such status. The logic leaves decision block 1314 by the YES output in such a situation, and proceeds to node B. By flowing to node B, the associated heat exchanger remains in the "SECONDARY" state or condition. On the other hand, if no "I AM PRIMARY" message is received before the expiry of the count of the counter 1312, the logic leaves decision block 1314 by the NO output, and proceeds to decision block 1316. From decision block 1316, the logic flows to block 1318, which deems the associated heat exchanger to be primary, and sets the associated status in local memory to PRIMARY. From block 1318, the logic flows to a block 1320, which sends an I AM PRIMARY message over the network, to thereby maintain all the other secondary-status heat exchangers in their secondary state. From block 1320, the logic flows to node B.

Figure 10:
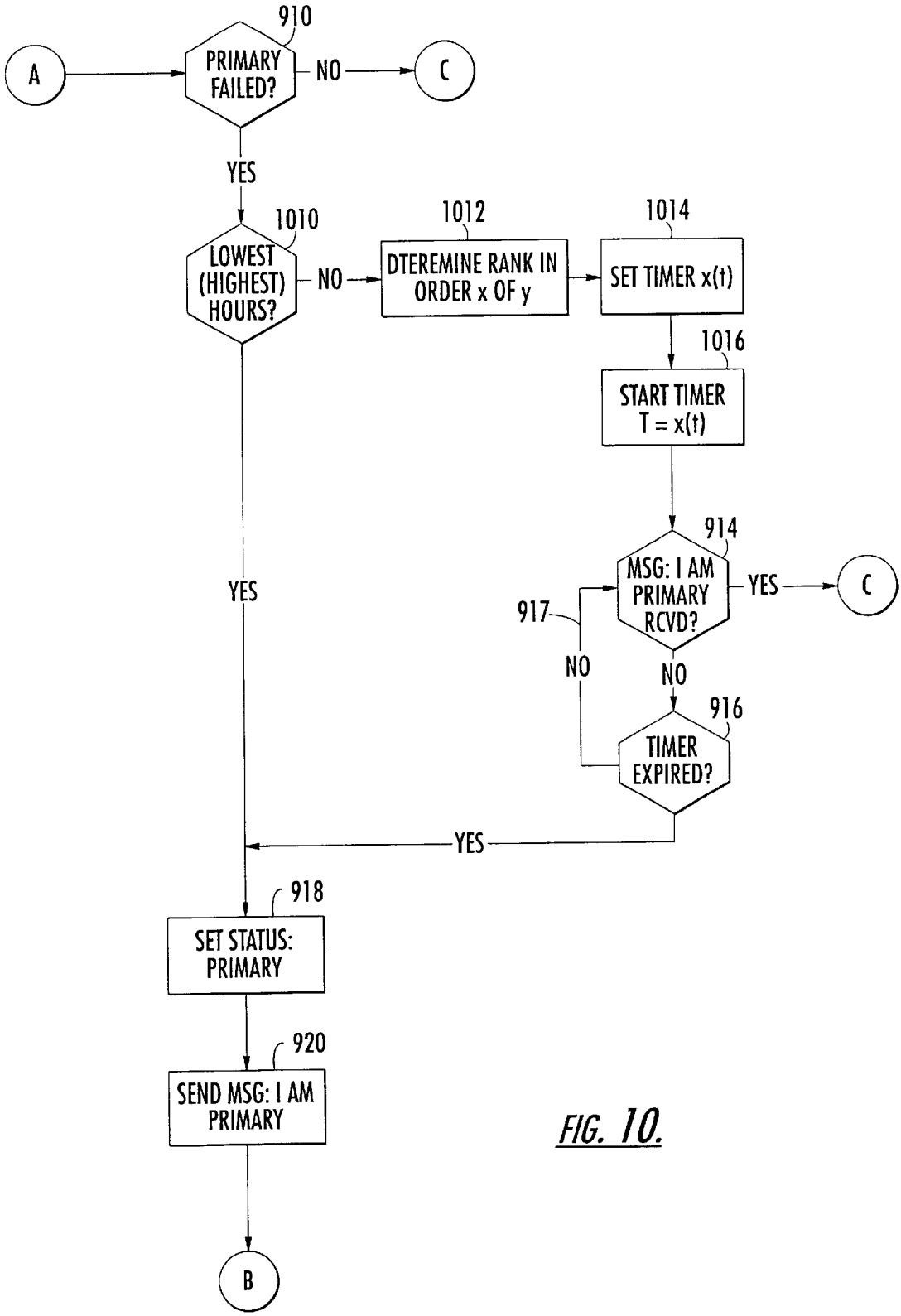
FIG. 10 is a simplified flow chart or diagram of logic which may be substituted for the logic of FIG. 9 for providing an alternative means for selecting among the secondary pumps.

FIG. 14 is a simplified logic flow chart or diagram illustrating an alternative arrangement for changing the status of the associated heat exchanger from SECONDARY to PRIMARY status. FIG. 14 is similar to FIG. 10, and corresponding elements are designated by like reference numerals in the 1400 series rather than in the 1000 series. In FIG. 14, the logic arrives at a decision block 1310 from node A, Decision block 1310 performs the same function as in FIG. 13. If the primary heat exchanger is not failed, the logic leaves decision block 1310 by the NO path, and proceeds to node C, as described in conjunction with FIG. 13. If the primary heat exchanger is failed, the logic leaves decision block 1310 by the YES output, and arrives at a further decision block 1410, which determines if the associated heat exchanger is the one with the lowest (or highest) number of hours. This is accomplished by simply ranking the stored hours information of the various heat exchangers (which information is received over the network) in ascending or descending order. If the associated heat exchanger is the highest- or lowest-ranked, as may be selected, the logic leaves decision block 1410 by the YES output, and proceeds to blocks 1318 and 1320, corresponding to those of FIG. 13, and thence to node B, having declared the associated heat exchanger to be primary. If the associated heat exchanger is not the highest-ranked (that is, having the greatest or least number of hours), some other heat exchanger is highest-ranked, and should send its own I AM PRIMARY message. It could happen that the next-ranked heat exchanger could be totally destroyed, which could result in the logic of FIG. 14 sitting and waiting for the occurrence of an I AM PRIMARY message from another heat exchanger, which message would never arrive. If decision block 1410 finds that the associated heat exchanger is not the highest- or lowest-ranked, the logic leaves by the NO output, and arrives at a block 1412, which determines the rank (x) of the associated heat exchanger among all the other available secondary heat exchangers (Y). This establishes how many potential secondary heat exchangers would sequentially attempt to become primary before the current one should assert itself as primary. For this purpose, an internal timer 1414 is set to a time interval x(t), where t is some interval deemed to be sufficient for any secondary heat exchangers to assert its or their primary nature. Thus, if the associated heat exchanger were the third-ranked of four secondary heat exchangers, the time interval set on the associated timer would be 3*t*, where t might be 1 millisecond, although it might be desirable to use 1 second when dealing with fairly slow processors and networks, representing the estimated time required for a single secondary heat exchanger to assert its primacy. From block 1414, the logic then proceeds to a block 1416, which starts the timer. At the expiry of the time period, the logic enters a logic circuit including decision blocks 1314 and 1316, which coact by means of a path 1317 as described in conjunction with FIG. 13, to route the logic to node B if a I AM PRIMARY message is received before the expiry of the timer count, and to route the logic to blocks 1318 and 13113 if the count expires before such a message is received. Thus, each of the various secondary heat exchangers can sequentially attempt to assert themselves as primary if the current primary heat exchanger fails.

Figure 15:
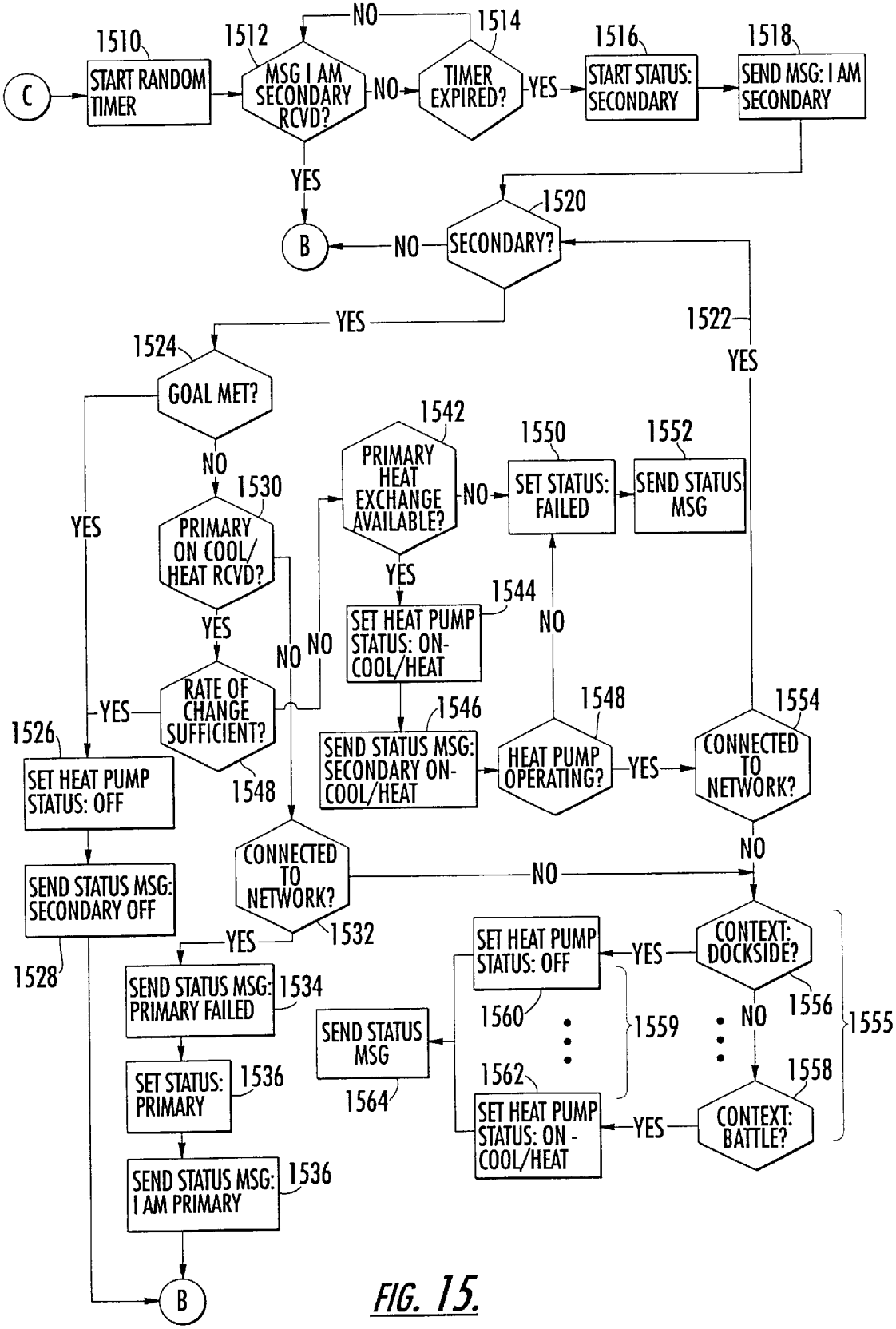
FIG. 15 is a simplified logic chart or diagram illustrating the logic flow of a portion of the control logic associated with that of FIG. 12 and that of either FIGS. 13 or 14.

FIG. 15 is a simplified logic chart or diagram illustrating the logic flow of a portion of the control logic associated with that of FIG. 12 and that of either FIG. 13 or 14. Processing can arrive at the logic network of FIG. 15 only from a C node of FIG. 13 or 14, which occurs only if the associated heat exchanger is secondary. In the case in which there are only two heat exchangers servicing a particular controlled environment, it is sufficient to identify the two heat exchangers as "primary" and "secondary," where the primary heat exchanger is used to control the environment, and the secondary heat exchanger supplements the primary if needed, or replaces it if the primary heat exchanger becomes inoperative. Where there are more than two heat exchangers servicing a given controlled environment, there must be additional differentiation among the plural secondary heat exchangers, so that, as the environment control load becomes more severe, the plural heat exchangers come on-line sequentially, rather than all at once. If they were to come on-line all at once, then they might, or more properly should, be considered to be a single secondary heat exchanger made up of plural paralleled units.

When the associated heat exchanger is secondary, the logic arrives at a random timer block 1510 of FIG. 15 and triggers the random timer. Decision block 1512 in conjunction with decision block 1514 determines if an I AM SECONDARY has arrived over the network from another heat exchanger in the interval since the timer 1510 was started. If some other heat exchanger has declared itself to be secondary, the logic leaves decision block 1512 by the YES output, and flows back by way of node B to start another iteration. In this state, the associated heat exchanger is NOT PRIMARY and NOT SECONDARY. If no other heat exchanger has declared itself to be SECONDARY while timer 1510 counted, the logic leaves decision block 1514 by the YES output, and arrives at a block 1516. Block 1516 represents the setting of the status of the associated heat exchanger to SECONDARY by setting a memory flag. From block 1516, the logic flows to a block 1518, which represents the broadcasting of an "I AM SECONDARY" message over the network. From block 1518, the logic proceeds to a decision block 1520. Decision block 1520 determines if the associated heat exchanger is secondary, which as so far described will always be the case, since the status was just set in block 1516. The status of the associated heat exchanger can, however, be other than secondary when the logic arrives at block 1520 from loop-back logic path 1522. If the current status is NOT SECONDARY, the logic leaves decision block 1520 by the NO path, and proceeds to node B, from which it leaves the logic of FIG. 15. On the other hand, if the current status is SECONDARY, the logic leaves decision block 1520 by the YES output, and arrives at a decision block 1524. Decision block 1524 compares the sensed environmental signal (temperature, humidity or the like, received over the network) with the set-point to determine if the goal has been met. If the goal is met, the logic proceeds by the YES output of block 1524 to a further block 1526, which represents the setting OFF of the associated heat pump, and the logic then proceeds to a block 1528, representing the sending of a network message indicating that the secondary heat exchanger is OFF. On the other hand, if the goal has not been met, the logic leaves decision block 1524 by the NO output, and proceeds to a decision block 1530, which looks to see if the network has reported that the primary heat exchanger is ON, and if such a message has not been received, the logic leaves decision block 1530 by way of the No output. From the NO output of decision block 1530, the logic arrives at decision block 1532. When the logic reaches decision block 1532, the goal has not been met, and the primary heat exchanger has not been reported as being ON. Decision block 1532 checks to see if the associated heat pump and controller are connected to the network, which, if they are not, might account for not having received a message indicating that the primary heat pump is ON. Such a check might be made by addressing a message to the network asking for a return message, and deeming the connection to be broken if no timely reply is received, or it might be made simply by noting the receipt of normal network traffic. If decision block 1532 finds that the associated controller is connected to the network, then the primary pump must really be OFF, or may be disconnected from the network. The logic leaves decision block 1532 by the YES output, and flows to a block 1534, which represents the sending of a network message "primary failed". From block 1534, the logic flows to a block 1536, which sets the status of the associated heat exchanger to PRIMARY. From block 1536, the logic flows to block 1538, which represents the sending of the network message "I AM PRIMARY." From block 1538, the logic flows to node B to begin another iteration of the logic of FIG. 12.

If decision block 1530 of FIG. 15 has received a message that the primary pump is ON, the failure to meet the goal must be attributable to insufficient heat pumping capacity, or possibly to normal delay while the primary heat pump extracts or adds heat to meet the set temperature. From block 1530, the logic leaves by the YES output, and arrives at a decision block 1540. Block 1540 examines a stored or memorized record of the values over time of the controlled variable, and possibly of the setpoint, to determine in any of a number of ways if the performance of the primary heat pump is satisfactory. One possible way to make such a determination is to determine the rate of change of the temperature or humidity, and to compare the rate of change with a rate-of-change setpoint value. Thus, if the rate of change of the temperature is, for example, 1° per hour, the load on the primary might be deemed not to be excessive, but any lower rate of change would require additional capacity. If the rate of change is deemed to be sufficient, the logic leaves decision block 1540 by the YES output, and proceeds to block 1526, which turns OFF the associated secondary heat exchanger. If, on the other hand, the rate of change with the primary heat exchanger ON is insufficient, the logic leaves decision block 1540 by the NO output, and arrives at a decision block 1542, which tests for fitness of the associated heat exchanger for duty. This may be performed by testing for the presence of heat exchange medium. If the primary heat exchange medium for the associated heat pump is available, as for example the circulation of water or the operation of a fan, decision block 1542 deems the associated heat exchanger fit for operation, and the logic leaves by Yes output. From the YES output of decision block 1542, the logic flows to a block 1544, which represents the turning ON or energizing of the associated heat exchanger to heating or cooling, as appropriate, to aid in handling the environmental load. From block 1544, the logic flows to a logic block 1546, representing the sending of a network message "secondary on". From block 1546, the logic flows to a decision block 1548, which uses some criterion to verify that the associated heat exchanger is ON, as for example by the use of a temperature sensor at the output of the heat exchanger. If the heat exchanger is not ON, as determined by the sensor, the logic leaves decision block 1548 by the NO output, and arrives at a block 1550. Block 1550 represents the setting of the status of the associated secondary heat pump to FAILED. Block 1552 represents the sending of the SECONDARY FAILED status message. The logic does not go anywhere from block 1552, because the associated heat exchanger isn't working, and presumably needs human attention. Other philosophies may require further routing of the logic.

In FIG. 15, the logic leaves decision block 1548 by the YES output if the associated secondary heat pump is operating, as indicated by the sensor. From the YES output of block 1548, the logic arrives at a "Network Connected?" decision block 1554. If the associated heat exchanger is connected to the network, the logic leaves decision block 1554 by the YES output, and flows by logic path 1522 back to block 1520. If the associated heat pump is not connected to the network, the logic leaves decision block 1554 by the NO output, and proceeds to a cascade 1555 of decision blocks 1556, . . . , 1558, each of which compares the current operating mode with previously assigned operating modes, as generally described in conjunction with the similar cascade 1243 of FIG. 12. In FIG. 15, cascade 1555 selects the current operating mode (last received over the network) with the various options provided by the cascade, and routes the logic to one of blocks 1560, . . . , 1562 of a set 1559 of blocks. Each block of set 1559 represents the setting of the operating state of the associated heat exchanger to that previously deemed to be appropriate for a network disconnection in the last known operating mode. From set 1559 of blocks 1560, . . . , 1562, the logic flows to a block 1564, representing the transmission over the network of the current status. This message may conceivably be received by other heat exchangers of the network, notwithstanding that the connection to the network has apparently been lost by the associated heat exchanger controller.

Other embodiments of the invention will be apparent to those skilled in the art. For example, while the described systems are responsive to temperature signals, heat exchangers operated in a humidifier or dehumidifier mode of operation might be responsive to humidity-representative signals; such a system might be used to control the humidity in a tobacco-drying barn where the temperature is not particularly relevant. While only electrical and mechanical drive of the powered cooler have been described, it is conceivable that chemically-, thermally- or even nuclear-powered heat exchangers could be used, so long as the source of power, or the coupling of the power to the heat exchanger, could be controlled by a control signal. While the heat exchangers and heat exchange assemblages have been described as using fluid as a heat transfer or coupling medium, simple thermal conduction through solids may be used instead.

Thus, a heat pump or heat exchange assemblage (1161) according to an aspect of the invention includes an independent controller **(1161*c*) associated with one powered heat pump (1116). Each of the heat pump assemblages (1161) is capable of operation in conjunction with a plurality of other such heat pump assemblages (1161) and in the presence of a network (70) linking the heat pump assemblages (1161). Each heat pump assemblage (1161) includes a powered heat pump or powered heat exchanger (1116) for pumping heat from one of a controlled environment and a heat sink (HS) to the other one of a controlled environment and a heat sink (HS). Thus, the powered heat pump (1116) may be an air conditioner, for example, pumping heat from a room to the exterior environment, to keep the controlled environment cool, or it may be a heat pump operating to pump heat from the exterior environment to heat the room. In either case, the room is the controlled environment. Of course, instead of a room, a heat exchanger could be used to heat or cool an equipment cabinet or a particular piece of equipment by use of air, water, or any fluid heat exchange medium. The power for the powered heat pump may be electrical or mechanical, as for example power may be from an electrical motor controllable in response to an electrical control signal, or from a water wheel including a controllable clutch responsive to a control signal. The heat pump assemblage (1161) also includes a controller (1161*c*) unique to the heat pump assemblage (1161), for generating the control signal (on path 1117) for controlling the powered heat pump (1116). The controller (1161*c*) includes a memory flag (and thus necessarily a memory for such information) indicative of the primary or secondary status of that heat pump assemblage (1161) with which it is associated. The controller (1161*c*) also includes a communication port (1161*cp*) and memory or further memory portion (1161*cm*) for receiving (over network 70 from sensor 1150) and at least temporarily storing at least one of (a) a temperature indication signal indicative of temperature of the controlled environment and (b) a humidity indication signal indicative of humidity of the controlled environment. Thus, it is contemplated that the heat exchanger (1161) may be for controlling the temperature of the controlled environment or the humidity thereof, or possibly both. The controller (1161*c*) determines the primary or secondary status of the associated heat pump assemblage (1161) by examining the memory flag and, if the status is primary, starts the associated powered heat pump (1116) in response to a comparison of one of (a) the temperature of the controlled environment as represented by the temperature indication signal and (b) the humidity of the controlled environment with a predetermined set point stored in memory. The set point can be received by way of the communication port (1161*cp*), or possibly by a local controller such as a keyboard (KB) andor knob. On the other hand, if the status is secondary, the associated powered heat pump (1116) is started in response to a comparison of the one of (a) the temperature of the controlled environment as represented by the temperature indication signal and (b) the humidity of the controlled environment as represented by the humidity indication signal with another humidity set point (also preferably received by way of the communication port), where the values of the first and second set points which is to say, the values of the humidity set points of the primary and secondary heat exchangers, may be equal. Thus, in these manifestations of the invention, the controllers (1161*c*) of the various heat exchange assemblages (1161) independently control their heat exchangers (1116)** substantially independently of each other.

In another avatar of the invention, a heat pump assemblage (1161) includes an independent controller **(1161*c*) capable of operation in conjunction with a plurality of such heat pump assemblages (1161) and in the presence of a network (70) linking the heat pump assemblages (1161). The or each heat pump assemblage (1161) includes a powered heat pump (1116) for pumping heat from one of a controlled environment and a heat sink (HS) to the other one of a controlled environment and a heat sink (HS). The power for the powered heat pump, whether electrical or mechanical, is controllable (as by switch 1118) in response to a control signal (on path 1117). The heat pump assemblage (1161) includes a controller (1161*c*) to unique to the heat pump assemblage (1161), for generating the control signal for controlling the associated powered heat pump. The controller (1161*c*) includes or processes a memory flag indicative of the primary or secondary status of that heat pump assemblage (1161) with which it is associated. The controller (1161*c*) also includes a communication port (1161*cp*) for receiving at least one of a temperature indication signal and a humidity indication signal indicative of temperature or humidity, respectively, of the controlled environment. In operation, the controller (1161*c*) determines (1212) the primary or secondary status of the associated heat pump assemblage (1161) by examining the memory flag and, if the status is primary, starts the associated powered heat pump (1230) in response to a comparison (1220) of the temperature of the controlled environment as represented by the temperature indication signal and (or with) a predetermined set point, which may be received by way of the communication port (1161***cp*). If the status is secondary, the associated powered heat pump (1116) is started (1540, 1544) in response to the rate of change of the temperature of the controlled environment as represented by the temperature indication signal and the humidity indication signal indicative of temperature or humidity, respectively, or possibly of both, of the controlled environment signal, with the determination (1542) being made after a signal is received (port 1161*cp*) which is indicative of operation of at least one other (PRIMARY) heat pump assemblage (1161). In general, this allows operation of a particular one of the secondary heat exchanger(s) to be delayed or avoided during any operating cycle if the rate of change of the controlled variable (temperature or humidity) in response to that one (or those) heat exchanger(s) already operating is sufficient.

What is claimed is:

1. A heat pump assemblage including an independent controller capable of operation in conjunction with a plurality of such heat pump assemblages and in the presence of a network linking said heat pump assemblages, said heat pump assemblage comprising:

a powered heat pump for pumping heat from one of a controlled environment and a heat sink to the other one of a controlled environment and a heat sink, the power for said powered heat pump being controllable in response to a control signal;

a controller unique to the heat pump assemblage, for generating said control signal for controlling said powered heat pump, said controller including a memory flag indicative of the primary or secondary status of that heat pump assemblage with which it is associated, said controller also including a communication port and memory for receiving and at least temporarily storing at least one of (a) a temperature indication signal indicative of temperature of said controlled environment and (b) a humidity indication signal indicative of humidity of said controlled environment, said controller being for determining said primary or secondary status of the associated heat pump assemblage by examining said memory flag and for, if said status is primary, starting the associated powered heat pump in response to a comparison of one of (a) said temperature of said controlled environment as represented by said temperature indication signal and (b) said humidity of said controlled environment and a predetermined set point received by way of said communication port, and for, if said status is secondary, starting the associated powered heat pump in response to a comparison of said one of (a) said temperature of said controlled environment as represented by said temperature indication signal and (b) said humidity of said controlled environment as represented by said humidity indication signal with another set point received by way of said communication port, where the values of said first and second set points may be equal.

2. An assemblage according to claim 1, wherein said controller further comprises a random timer, and means for establishing the status as PRIMARY or SECONDARY of the associated heat pump in response to the time of expiry of the count of said random timer relative to a message indicative that another assemblage has deemed itself to be the other one of said PRIMARY and SECONDARY.

3. An assemblage according to claim 1, wherein said controller further comprises means for commanding the sending of a message indicative of the status of said assemblage by way of said communication port.

4. An assemblage according to claim 1, wherein said controller, in at least one mode of operation, autonomously determines the action to be taken when said communication port is not receiving messages, in response to a set of predetermined actions selected in response to the last operating mode received at said communication port.

5. An assemblage according to claim 2, wherein said controller, when in said SECONDARY mode, actuates said powered heat pump in response to the rate of change of said one of (a) said temperature of said controlled environment and (b) said humidity of said controlled environment.

* * * * *